US010391006B2

(12) United States Patent
Magill et al.

(10) Patent No.: US 10,391,006 B2
(45) **Date of Patent: *Aug. 27, 2019**

(54) POWERED ROLL-IN COTS HAVING WHEEL ALIGNMENT MECHANISMS

(71) Applicant: Ferno-Washington, Inc., Wilmington, OH (US)

(72) Inventors: Brian Magill, Wilmington, OH (US); Nicholas Vittorio Valentino, Dayton, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/972,998

(22) Filed: May 7, 2018

(65) Prior Publication Data

US 2018/0250177 A1 Sep. 6, 2018

Related U.S. Application Data

(63) Continuation of application No. 14/770,126, filed as application No. PCT/US2014/019056 on Feb. 27, 2014, now Pat. No. 9,999,555.

(Continued)

(51) Int. Cl.

*A61G 1/013* (2006.01)
*A61G 1/02* (2006.01)

(Continued)

(52) U.S. Cl.

CPC ..... *A61G 1/013* (2013.01); *A61G 1/0212* (2013.01); *A61G 1/0237* (2013.01);

(Continued)

(58) Field of Classification Search

CPC ..... A61G 1/013; A61G 1/02; A61G 1/0237; A61G 1/052; A61G 1/056; A61G 1/0565; A61G 1/0567

See application file for complete search history.

(56) References Cited

U.S. PATENT DOCUMENTS 446,666 A 2/1891 Edison
2,203,204 A 6/1940 Nicolai (Continued)

FOREIGN PATENT DOCUMENTS

CN 102781392 A 11/2012
EP 1698314 B1 4/2010

(Continued)

OTHER PUBLICATIONS

Non-Final Office Action dated Nov. 2, 2018, pertaining to U.S. Appl. No. 14/979,748 60 pages.

(Continued)

*Primary Examiner* — Hilary L Gutman
(74) *Attorney, Agent, or Firm* — Dinsmore & Shohl, LLP

(57) ABSTRACT

Roll-in cots having wheel alignment mechanisms. According to one embodiment, a roll-in cot includes a support frame, a pair of legs pivotably and slidably coupled to the support frame, and a pair of hinge members that are pivotably coupled to the support frame and to one of the legs. The roll-in cot also includes a wheel linkage pivotably coupled to the pair of legs and a wheel alignment mechanism. The legs and the hinge members pivot relative to one another in a relative angular rotation ratio and the wheel alignment mechanism rotates the wheel alignment mechanism relative to the hinge members at a reduction ratio. The relative angular rotation ratio of the legs and the hinge members is approximately inverse to the reduction ratio of the wheel alignment mechanism.

11 Claims, 16 Drawing Sheets

Related U.S. Application Data

(60) Provisional application No. 61/835,042, filed on Jun. 14, 2013, provisional application No. 61/769,918, filed on Feb. 27, 2013.

(51) Int. Cl.
*A61G 1/04* (2006.01)
*A61G 1/044* (2006.01)
*A61G 1/056* (2006.01)

(52) U.S. Cl.
CPC ..... *A61G 1/0243* (2013.01); *A61G 1/0256* (2013.01); *A61G 1/0262* (2013.01); *A61G 1/0293* (2013.01); *A61G 1/04* (2013.01); *A61G 1/044* (2013.01); *A61G 1/0562* (2013.01); *A61G 2203/40* (2013.01); *A61G 2203/42* (2013.01)

(56) References Cited

U.S. PATENT DOCUMENTS 2,204,205 A 6/1940 Bell
2,278,749 A 4/1942 Todd
2,642,250 A 6/1953 Kasnowich
3,397,912 A 8/1968 Beaufort Bush
3,544,163 A 12/1970 Krein
3,612,606 A 10/1971 Swenson
3,631,546 A 1/1972 Eliasson
3,888,077 A 6/1975 Bachmann
3,951,452 A 4/1976 Harder, Jr.
4,037,871 A 7/1977 Bourgraf et al.
4,073,538 A 2/1978 Hunter
4,155,588 A 5/1979 Danziger et al.
4,186,905 A 2/1980 Brudy
4,225,183 A 9/1980 Hanagan et al.
4,270,798 A 6/1981 Harder
D289,992 S 5/1987 Schrager
4,682,810 A 7/1987 Zarka
4,745,647 A 5/1988 Goodwin
4,761,841 A 8/1988 Larsen
4,767,148 A 8/1988 Ferneau et al.
4,829,633 A 5/1989 Kassner
4,921,295 A 5/1990 Stollenwerk
5,015,024 A 5/1991 Bloemer
5,023,968 A 6/1991 Diehl et al.
5,039,118 A 8/1991 Huang
5,056,805 A 10/1991 Wang
5,062,179 A 11/1991 Huang
5,069,465 A 12/1991 Stryker et al.
5,084,922 A 2/1992 Louit
5,088,136 A 2/1992 Stryker et al.
5,168,601 A 12/1992 Liu
5,265,969 A 11/1993 Chuang
5,431,087 A 7/1995 Kambara
5,509,159 A 4/1996 Du-Bois
5,537,700 A 7/1996 Way et al.
5,586,346 A 12/1996 Stacy et al.
5,630,428 A 5/1997 Wallace
5,720,057 A 2/1998 Duncan
5,774,914 A 7/1998 Johnson et al.
5,839,136 A 11/1998 Vance et al.
5,867,911 A 2/1999 Yates et al.
5,971,091 A 10/1999 Kamen et al.
5,996,954 A 12/1999 Rosen et al.
6,311,952 B2 11/2001 Bainter
D454,319 S 3/2002 Ito
6,405,393 B2 6/2002 Megown
6,503,018 B2 1/2003 Hou et al.
6,550,801 B1 4/2003 Newhard
6,565,111 B2 5/2003 Ageneau
6,578,922 B2 6/2003 Khedira et al.
6,654,973 B2 12/2003 Van Den Heuvel et al.
6,735,794 B1 5/2004 Way et al.
6,752,462 B1 6/2004 Kain et al.
6,789,292 B2 9/2004 Oshima et al.
6,948,197 B1 9/2005 Chen
6,976,696 B2 12/2005 O'Krangley et al.
7,003,829 B2 2/2006 Choi et al.
7,013,510 B1 3/2006 Johnson
7,273,256 B2 9/2007 Jane Santamaria
7,278,338 B2 10/2007 Chen
7,389,552 B1 6/2008 Reed et al.
7,398,571 B2 7/2008 Souke et al.
7,424,758 B2 9/2008 Broadley et al.
7,426,970 B2 9/2008 Olsen
7,540,047 B2 6/2009 Lambarth
7,568,766 B2 8/2009 Chen et al.
7,617,569 B2 11/2009 Liao
7,621,003 B2 11/2009 Myers et al.
7,631,373 B2 12/2009 Broadley et al.
7,631,575 B2 12/2009 Gard et al.
7,637,550 B2 12/2009 Menna
7,641,211 B2 1/2010 Ivanchenko
7,685,660 B2 3/2010 Chinn
7,694,368 B2 4/2010 Lewis, Jr.
7,841,611 B2 11/2010 Ivanchenko
7,857,393 B2 12/2010 Cebula et al.
7,941,881 B2 5/2011 Hayes et al.
7,996,939 B2 8/2011 Benedict et al.
8,051,513 B2 11/2011 Reed et al.
8,056,950 B2 11/2011 Souke et al.
8,100,307 B2 1/2012 Chinn et al.
8,239,983 B2 8/2012 Chinn
8,240,410 B2 8/2012 Heimbrock et al.
8,439,416 B2 5/2013 Lambarth et al.
8,459,679 B2 6/2013 Jessie, Jr.
RE44,884 E 5/2014 Lambarth
8,714,612 B2 5/2014 Chinn
8,898,862 B1 12/2014 McGrath
8,901,747 B2 12/2014 Miller et al.
9,021,634 B2 5/2015 Goto et al.
9,233,033 B2 1/2016 Valentino et al.
9,248,062 B2 2/2016 Valentino et al.
9,456,938 B2 * 10/2016 Blickensderfer .... A61G 1/0212
9,510,982 B2 12/2016 Valentino et al.
9,789,020 B2 10/2017 Blickensderfer et al.
10,045,894 B2 * 8/2018 Magill ..... A61G 1/0212
10,098,796 B2 * 10/2018 Valentino ..... A61G 1/013
10,130,528 B2 * 11/2018 Valentino ..... A61G 1/0562
2002/0056162 A1 5/2002 Flynn et al.
2002/0174486 A1 11/2002 Heuvel et al.
2003/0025378 A1 2/2003 Lin
2003/0172459 A1 9/2003 Roussy
2004/0088792 A1 5/2004 O'Krangley et al.
2004/0111798 A1 6/2004 Matunaga et al.
2005/0126835 A1 6/2005 Lenkman
2005/0283911 A1 12/2005 Roussy
2006/0017263 A1 1/2006 Chen et al.
2006/0075558 A1 4/2006 Lambarth et al.
2006/0096029 A1 5/2006 Osborne et al.
2006/0225203 A1 10/2006 Hosoya et al.
2006/0265807 A1 11/2006 Choy et al.
2007/0165044 A1 7/2007 Wells et al.
2007/0245496 A1 10/2007 Chinn
2008/0028527 A1 2/2008 Lewis
2008/0128571 A1 6/2008 Dostaler et al.
2008/0211248 A1 9/2008 Lambarth
2009/0165208 A1 7/2009 Reed et al.
2009/0172883 A1 7/2009 Benedict et al.
2009/0222988 A1 9/2009 Reed et al.
2009/0313758 A1 12/2009 Menkedick et al.
2010/0199430 A1 8/2010 Chinn
2010/0306921 A1 12/2010 Kramer
2011/0080016 A1 4/2011 Lambarth et al.
2011/0087416 A1 4/2011 Patmore
2011/0260417 A1 10/2011 Bitzer et al.
2011/0265262 A1 11/2011 Di Lauro et al.
2011/0266821 A1 11/2011 Goto et al.
2011/0277773 A1 11/2011 Sullivan et al.
2012/0275896 A1 11/2012 Magill et al.
2013/0168987 A1 7/2013 Valentino et al.
2014/0059768 A1 3/2014 Lemire et al.
2014/0276269 A1 9/2014 Illindala
2015/0216747 A1 8/2015 Valentino et al.

(56) References Cited

U.S. PATENT DOCUMENTS

| | | | |
|---|---|---|---|
| 2016/0106605 | A1 | 4/2016 | Valentino et al. |
| 2016/0128880 | A1 | 5/2016 | Blickensderfer et al. |
| 2016/0374884 | A1 | 12/2016 | Blickensderfer et al. |
| 2017/0367915 | A1 | 12/2017 | Blickensderfer et al. |

FOREIGN PATENT DOCUMENTS

| | | | | | |
|---|---|---|---|---|---|
| EP | 2412355 | A1 | | 2/2012 | |
| GB | 2351439 | A | | 1/2001 | |
| JP | 02011955 | | | 1/1990 | |
| JP | 02200262 | A | | 8/1990 | |
| JP | 2001197962 | A | | 7/2001 | |
| JP | 2002543927 | A | | 12/2002 | |
| JP | 2016198578 | A | | 12/2016 | |
| JP | 2018079377 | A | * | 5/2018 | ..... A61G 1/0212 |
| NL | 8901747 | A | | 2/1991 | |
| WO | 0069386 | A2 | | 11/2000 | |
| WO | 2011088169 | A1 | | 7/2011 | |

OTHER PUBLICATIONS

Timing Belt Idler from Repair Pal, Dec. 8, 2016 (5 pages) http://repairpal.com/timing-belt-idler.

Tensioner from Wikipedia, Dec. 8, 2016 (4 pages), https://en.wikipedia.org/wiki/Tensioner.

"Timing Belt Tensioner", Automotive Care Wayback Machine-Internet Archive: archived from Dec. 29, 2014 http://web.archive.org/web/20141229221712/http://www.automotivecare.com/your-engine-101/belts-and-tensioners/.

Japanese Office Action dated Dec. 4, 2018, pertaining to Japanese patent application No. 2015-560317.

* cited by examiner

POWERED ROLL-IN COTS HAVING WHEEL ALIGNMENT MECHANISMS

CROSS REFERENCE TO RELATED APPLICATIONS

The present application claims the benefit of and priority to U.S. Provisional Patent Application Ser. No. 61/769,918 filed Feb. 27, 2013 and U.S. Provisional Patent Application Ser. No. 61/835,042 filed Jun. 14, 2013, the entire disclosures of which are hereby incorporated by reference.

This application is a continuation of U.S. patent application Ser. No. 14/770,126, filed Aug. 25, 2015, which is a National Phase of PCT/US2014/019056 filed Feb. 27, 2014.

TECHNICAL FIELD

The present disclosure is generally related to emergency cots, and is specifically directed to powered roll-in cots having wheel alignment mechanisms.

BACKGROUND ART

There are a variety of emergency cots in use today. Such emergency cots may be designed to transport and load patients into an ambulance.

For example, the PROFlexX® cot, by Ferno-Washington, Inc. of Wilmington, Ohio U.S.A., is a manually actuated cot that may provide stability and support for loads of about 700 pounds (about 317.5 kg). The PROFlexX® cot includes a patient support portion that is attached to a wheeled undercarriage. The wheeled under carriage includes an X-frame geometry that can be transitioned between nine selectable positions. One recognized advantage of such a cot design is that the X-frame provides minimal flex and a low center of gravity at all of the selectable positions. Another recognized advantage of such a cot design is that the selectable positions may provide better leverage for manually lifting and loading bariatric patients.

Another example of a cot designed for bariatric patients, is the POWERFlexx+ Powered Cot, by Ferno-Washington, Inc. The POWERFlexx+ Powered Cot includes a battery powered actuator that may provide sufficient power to lift loads of about 700 pounds (about 317.5 kg). One recognized advantage of such a cot design is that the cot may lift a bariatric patient up from a low position to a higher position, i.e., an operator may have reduced situations that require lifting the patient.

A further variety is a multipurpose roll-in emergency cot having a patient support stretcher that is removably attached to a wheeled undercarriage or transporter. The patient support stretcher when removed for separate use from the transporter may be shuttled around horizontally upon an included set of wheels. One recognized advantage of such a cot design is that the stretcher may be separately rolled into an emergency vehicle such as station wagons, vans, modular ambulances, aircrafts, or helicopters, where space and reducing weight is a premium.

Another advantage of such a cot design is that the separated stretcher may be more easily carried over uneven terrain and out of locations where it is impractical to use a complete cot to transfer a patient. Example of such conventionally known cots can be found, for example, in U.S. Pat. Nos. 4,037,871, 4,921,295, and International Publication No. WO2001/070161.

Although the foregoing multipurpose roll-in emergency cots have been generally adequate for their intended purposes, they have not been satisfactory in all aspects. Accordingly, powered roll-in cots having wheel alignment mechanisms are needed.

SUMMARY OF INVENTION

The embodiments described herein address are directed to a versatile multipurpose roll-in emergency cot which may provide improved management of the cot weight, improved balance, and/or easier loading at any cot height, while being rollable into various types of rescue vehicles, such as ambulances, vans, station wagons, aircrafts and helicopters.

According to one embodiment, a roll-in cot includes a support frame, a first pair of legs pivotably and slidably coupled to the support frame, and a first pair of hinge members. Each hinge member is pivotably coupled to the support frame and to one of the first pair of legs. The roll-in cot also includes a first wheel linkage pivotably coupled to the first pair of legs and a wheel alignment mechanism incorporated into at least one of the first pair of legs. The wheel alignment mechanism includes a timing mechanism that is coupled to one of the first pair of hinge members and the first wheel linkage. The first pair of legs and the first pair of hinge members pivot relative to one another in a relative angular rotation ratio and the wheel alignment mechanism rotates the wheel alignment mechanism relative to the first pair of hinge members at a reduction ratio. The relative angular rotation ratio of the first pair of legs and the first pair of hinge members is approximately inverse to the reduction ratio of the wheel alignment mechanism.

In another embodiment, a roll-in cot includes a support frame, a first pair of legs pivotably coupled to the support frame, and a first pair of hinge members, where each hinge member pivotably coupled to the support frame and to one of the first pair of legs. The roll-in cot includes a first wheel linkage pivotably coupled to the first pair of legs and a wheel alignment mechanism incorporated into at least one of the first pair of legs. The wheel alignment mechanism comprising a timing mechanism, a first hub that is coupled to one of the first pair of hinge members, and a second hub that is coupled to the first wheel linkage. One of the first pair of legs or the first pair of hinge members are slidably coupled to the support frame. The first pair of legs and the first pair of hinge members pivot relative to one another in a relative angular rotation ratio. The timing mechanism is coupled to the first hub and the second hub, and communicates relative rotation of the first pair of hinge members to the first wheel linkage. The wheel alignment mechanism rotates the wheel alignment mechanism relative to the first pair of hinge members at a reduction ratio. The relative angular rotation ratio of the first pair of legs and the first pair of hinge members is approximately inverse to the reduction ratio of the wheel alignment mechanism.

In yet another embodiment, a roll-in cot includes a support frame having a front end and a back end, a front pair of legs pivotably coupled to the support frame, a front hinge member pivotably coupled to the support frame and to one of the front pair of legs, and a front wheel linkage pivotably coupled to the front pair of legs. The roll-in cot also includes a rear pair of legs pivotably coupled to the support frame, a rear hinge member pivotably coupled to the support frame and to one of the rear pair of legs, and a rear wheel linkage pivotably coupled to the rear pair of legs. The roll-in cot further includes a wheel alignment mechanism incorporated into at least one of the front or rear pairs of legs, the wheel alignment mechanism comprising a timing mechanism that is coupled to the respective hinge member and the respective wheel linkage. The front pair of legs and the rear pair of legs are pivotable relative to the support frame and independently of one another. The front pair of legs and the front pair of hinge members pivot relative to one another in a relative angular rotation ratio and the rear pair of legs and the rear pair of hinge members pivot relative to one another in a relative angular rotation ratio. The timing mechanism is coupled to the first hub and the second hub, and communicates relative rotation of the respective pair of hinge members to the respective wheel linkage. The wheel alignment mechanism rotates the wheel alignment mechanism relative to the respective pair of hinge members at a reduction ratio and the relative angular rotation ratio of the respective pair of legs and the respective hinge member is approximately inverse to the reduction ratio of the wheel alignment mechanism.

These and additional features provided by the embodiments of the present disclosure will be more fully understood in view of the following detailed description, in conjunction with the drawings.

BRIEF DESCRIPTION OF THE DRAWINGS

The following detailed description of specific embodiments of the present disclosures can be best understood when read in conjunction with the following drawings, where like structure is indicated with like reference numerals and in which.

Figure 1:
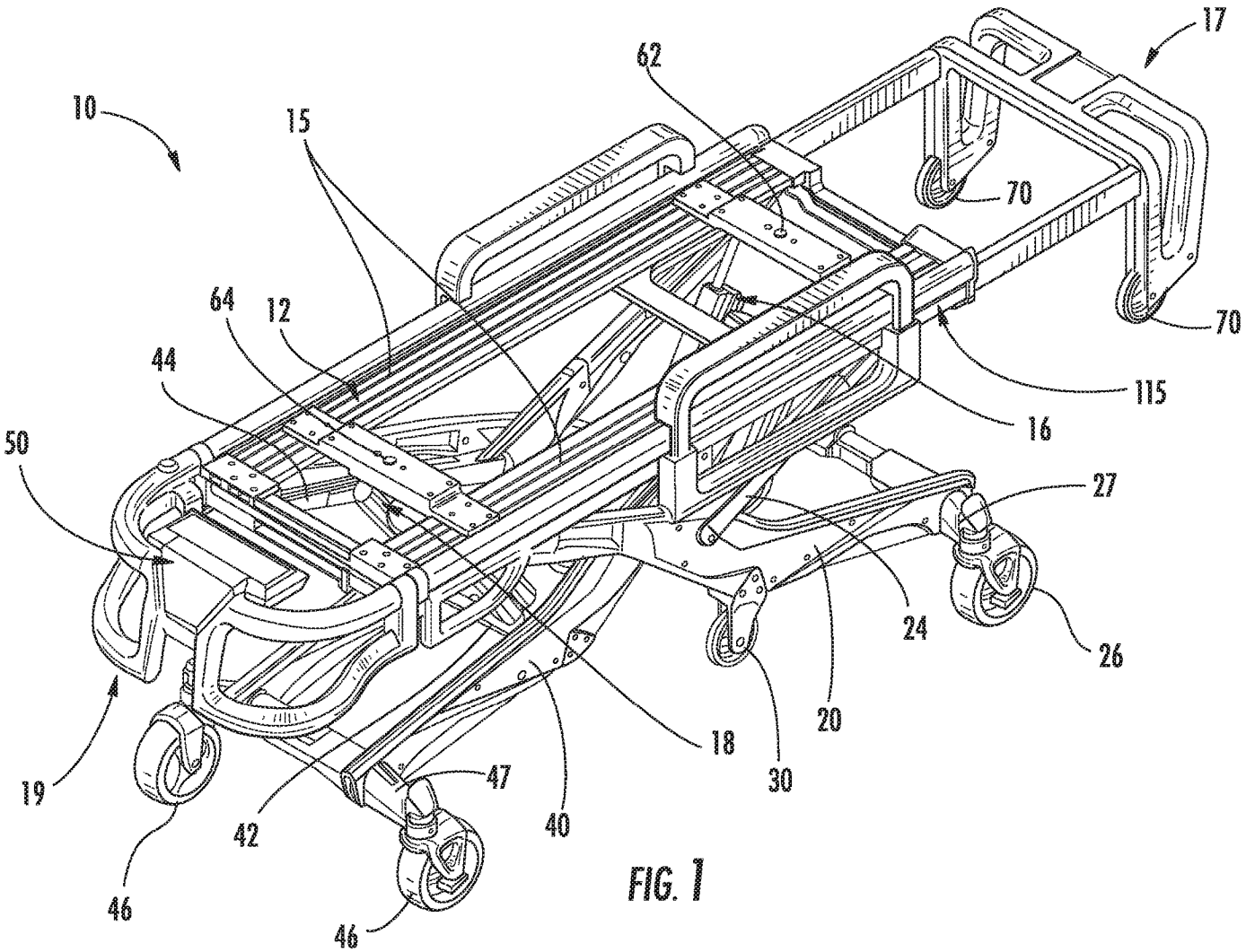
FIG. 1 is a perspective view depicting a cot according to one or more embodiments shown or described herein.

The embodiments set forth in the drawings are illustrative in nature and not intended to be limiting of the embodiments described herein. Moreover, individual features of the drawings and embodiments will be more fully apparent and understood in view of the detailed description.

DESCRIPTION OF EMBODIMENTS

Referring to FIG. 1, a roll-in cot 10 for transport and loading is shown. The roll-in cot 10 comprises a support frame 12 comprising a front end 17, and a back end 19. As used herein, the front end 17 is synonymous with the loading end, i.e., the end of the roll-in cot 10 which is loaded first onto a loading surface. Conversely, as used herein, the back end 19 is the end of the roll-in cot 10 which is loaded last onto a loading surface. Additionally it is noted, that when the roll-in cot 10 is loaded with a patient, the head of the patient may be oriented nearest to the front end 17 and the feet of the patient may be oriented nearest to the back end 19. Thus, the phrase "head end" may be used interchangeably with the phrase "front end," and the phrase "foot end" may be used interchangeably with the phrase "back end." Furthermore, it is noted that the phrases "front end" and "back end" are interchangeable. Thus, while the phrases are used consistently throughout for clarity, the embodiments described herein may be reversed without departing from the scope of the present disclosure. Generally, as used herein, the term "patient" refers to any living thing or formerly living thing such as, for example, a human, an animal, a corpse and the like.

Figure 2:
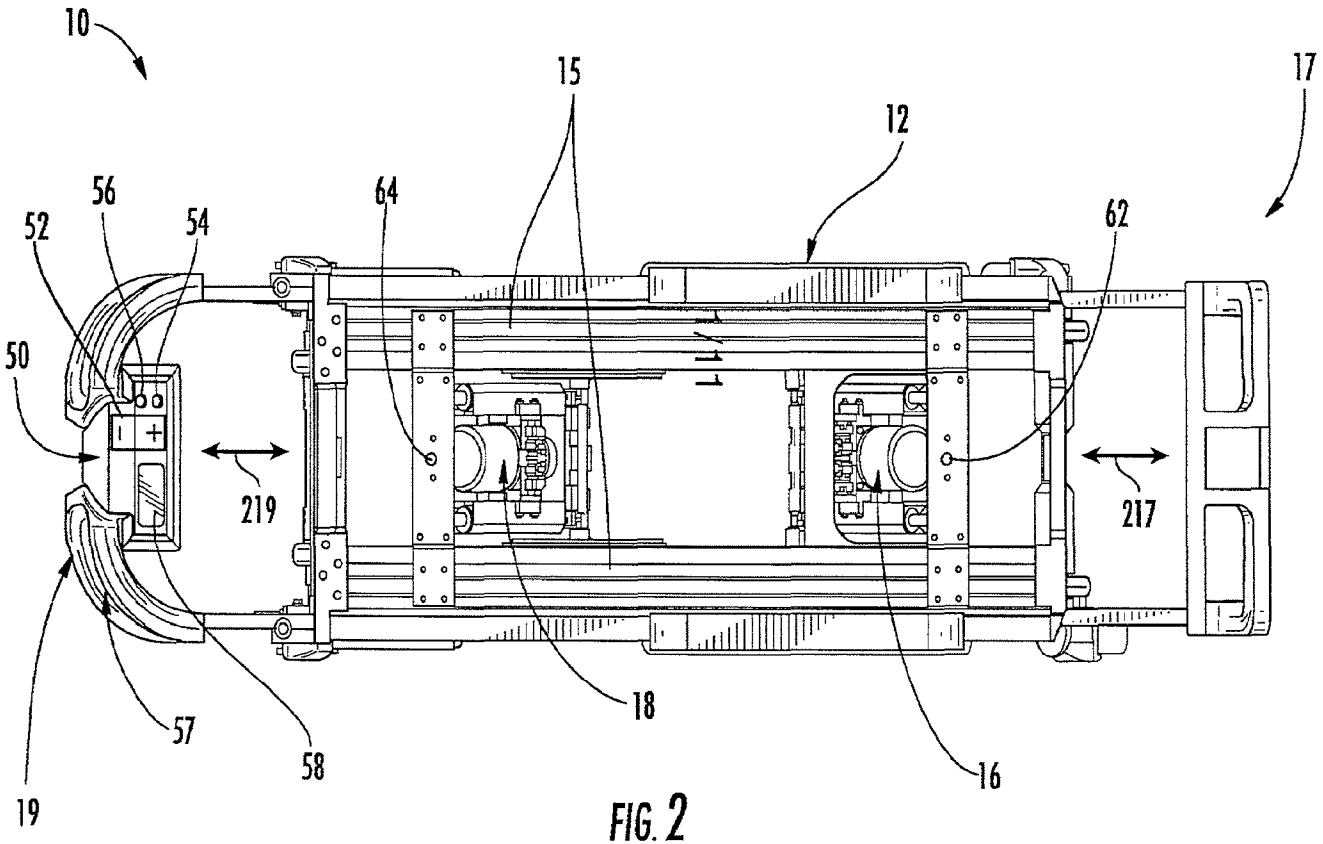
FIG. 2 is a top view depicting a cot according to one or more embodiments shown or described herein.
Figure 3:
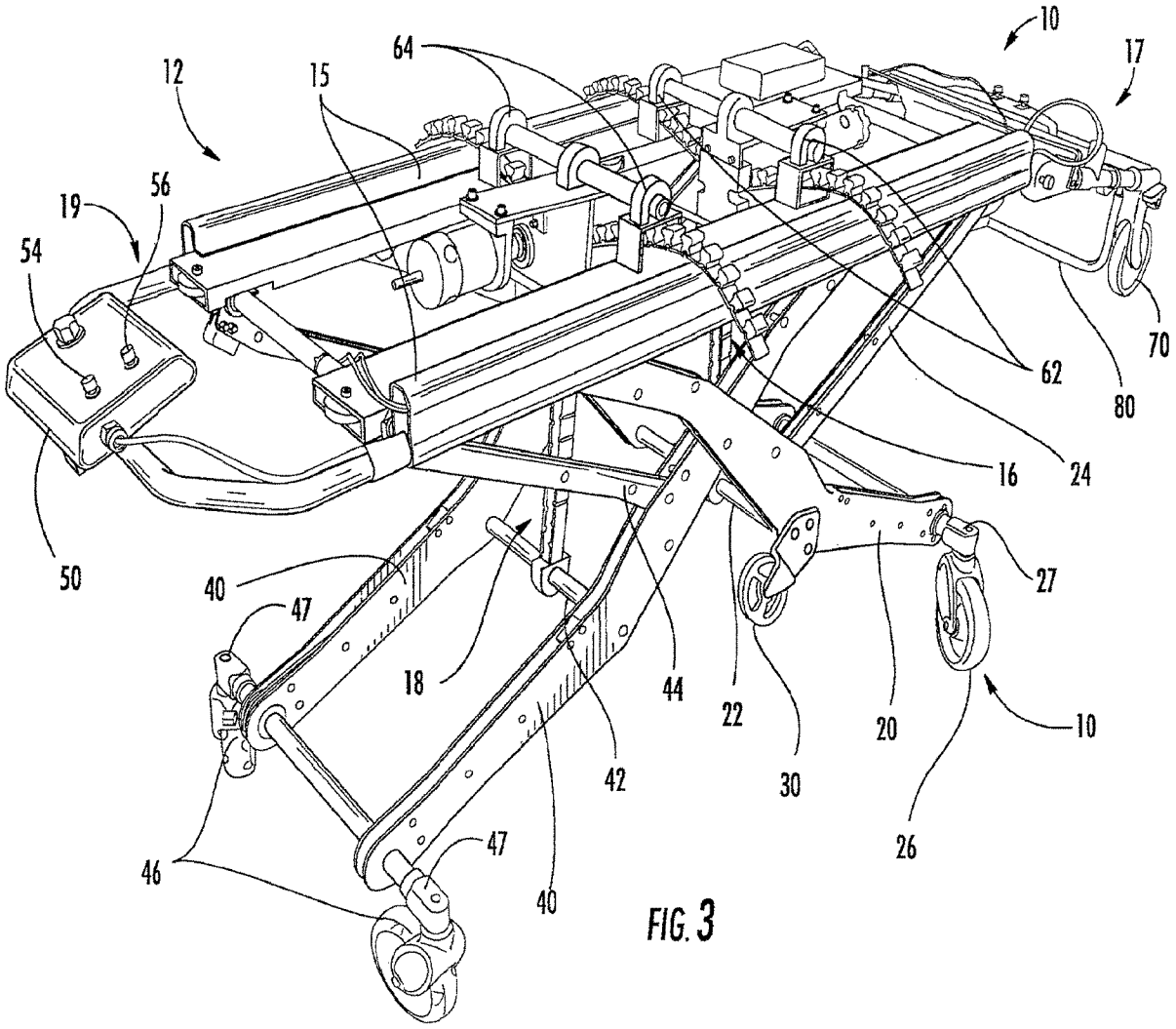
FIG. 3 is a perspective view depicting a cot according to one or more embodiments shown or described herein.
Figure 4:
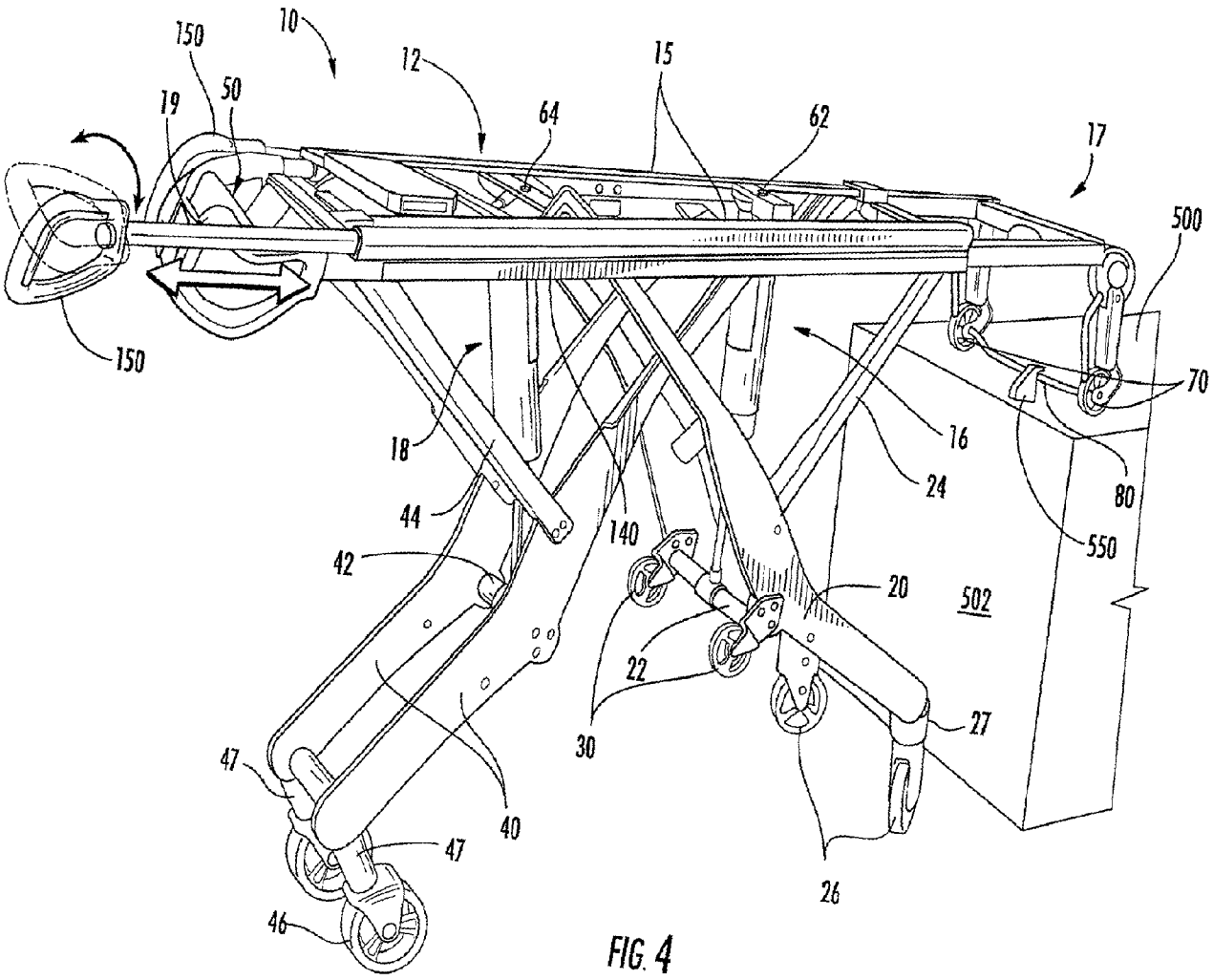
FIG. 4 is a perspective view depicting a cot according to one or more embodiments shown or described herein.

Referring collectively to FIGS. 2 through 4, the front end 17 and/or the back end 19 may be telescoping. In one embodiment, the front end 17 may be extended and/or retracted (generally indicated in FIG. 2 by arrow 217). In another embodiment, the back end 19 may be extended and/or retracted (generally indicated in FIG. 2 by arrow 219). Thus, the total length between the front end 17 and the back end 19 may be increased and/or decreased to accommodate various sized patients. Furthermore, as depicted in FIG. 4, the rear end 19 may comprise telescoping lift handles 150. The telescoping lift handles 150 may telescope away from the support frame 12 to provide lifting leverage and telescope towards the support frame 12 to be stored. In some embodiments, the telescoping lift handles 150 are pivotingly coupled to the support frame 12 and are rotatable from a vertical handle orientation to a side handle orientation, and vice versa. The telescoping lift handles 150 may lock in the vertical handle orientation and the side handle orientation. In one embodiment, when the telescoping lift handles 150 are in the side handle orientation, the telescoping lifting handles 150 provide a gripping surface adjacent to the support frame 12 and are each configured to be gripped by a hand with the palm substantially facing up and/or down. Conversely, when the telescoping lift handles 150 are in the vertical handle orientation, the telescoping lifting handles 150 may each be configured to be gripped by a hand with the thumb substantially pointing up and/or down.

Referring collectively to FIGS. 1 and 2, the support frame 12 may comprise a pair of parallel lateral side members 15 extending between the front end 17 and the back end 19. Various structures for the lateral side members 15 are contemplated. In one embodiment, the lateral side members 15 may be a pair of spaced metal tracks. In another embodiment, the lateral side members 15 comprise an undercut portion 115 that is engageable with an accessory clamp (not depicted). Such accessory clamps may be utilized to removably couple patient care accessories such as a support pole for an IV drip to the undercut portion 115. The undercut portion 115 may be provided along the entire length of the lateral side members to allow accessories to be removably clamped to many different locations on the roll-in cot 10.

Referring again to FIG. 1, the roll-in cot 10 also comprises a pair of retractable and extendible front legs 20 coupled to the support frame 12, and a pair of retractable and extendible back legs 40 coupled to the support frame 12. The roll-in cot 10 may comprise any rigid material such as, for example, metal structures or composite structures. Specifically, the support frame 12, the front legs 20, the back legs 40, or combinations thereof may comprise a carbon fiber and resin structure. As is described in greater detail herein, the roll-in cot 10 may be raised to multiple heights by extending the front legs 20 and/or the back legs 40, or the roll-in cot 10 may be lowered to multiple heights by retracting the front legs 20 and/or the back legs 40. It is noted that terms such as "raise," "lower," "above," "below," and "height" are used herein to indicate the distance relationship between objects measured along a line parallel to gravity using a reference (e.g. a surface supporting the cot).

Figure 8:
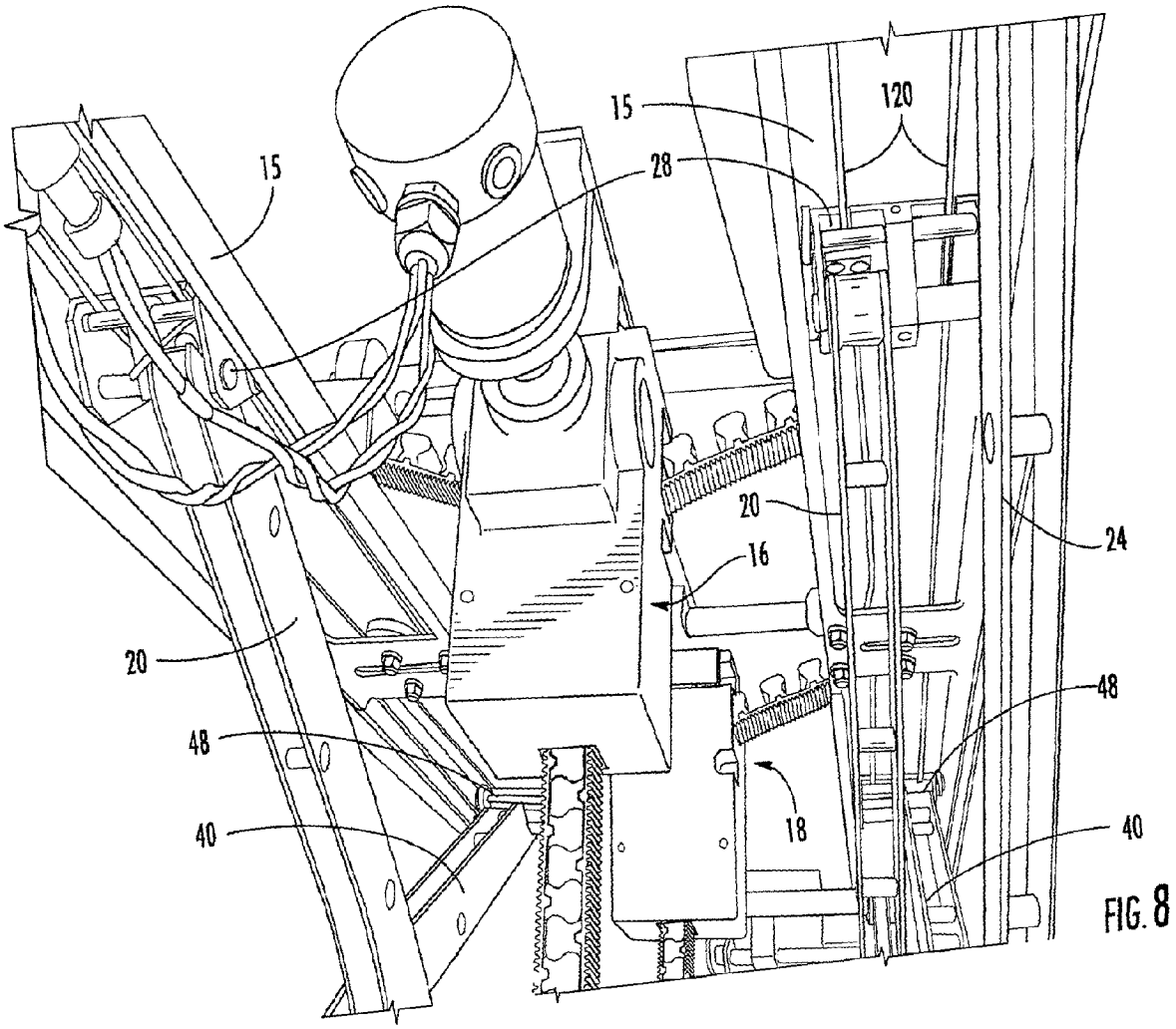
FIG. 8 perspective view depicting a cot according to one or more embodiments shown or described herein.

In specific embodiments, the front legs 20 and the back legs 40 may each be coupled to the lateral side members 15. Referring to FIG. 8, the front legs 20 may comprise front carriage members 28 slidingly coupled to the tracks of lateral side members 15, and the back legs 40 may also comprise back carriage members 48 slidingly coupled to the tracks of lateral side members 15. Referring to FIGS. 5A-6E and 10, when the roll-in cot 10 is raised or lowered, the carriage members 28 and/or 48 slide inwardly or outwardly, respectively along the tracks of the lateral side members 15.

As shown in FIGS. 5A-6E, the front legs 20 and the back legs 40 may cross each other, when viewing the cot from a side, specifically at respective locations where the front legs 20 and the back legs 40 are coupled to the support frame 12 (e.g., the lateral side members 15 as shown in FIGS. 1-4). As shown in the embodiment of FIG. 1, the back legs 40 may be disposed inwardly of the front legs 20, i.e., the front legs 20 may be spaced further apart from one another than the back legs 40 are spaced from one another such that the back legs 40 are each located between the front legs 20. Additionally, the front legs 20 and the back legs 40 may comprise front wheels 26 and back wheels 46 which enable the roll-in cot 10 to roll.

In one embodiment, the front wheels 26 and back wheels 46 may be swivel caster wheels or swivel locked wheels. As is described below, as the roll-in cot 10 is raised and/or lowered, the front wheels 26 and back wheels 46 may be synchronized to ensure that the plane of the roll-in cot 10 and the plane of the wheels 26, 46 are substantially parallel. For example, the back wheels 46 may each be coupled to a back wheel linkage 47 and the front wheels 26 may each be coupled to a front wheel linkage 27. As the roll-in cot 10 is raised and/or lowered, the front wheel linkages 27 and the back wheel linkages 47 may be rotated to control the plane of the wheels 26, 46.

A locking mechanism (not depicted) may be disposed in one of the front wheel linkages 27 and the back wheel linkages 47 to allow an operator to selectively enable and/or disable wheel direction locking. In one embodiment, a locking mechanism is coupled to one of the front wheels 26 and/or one of the back wheels 46. The locking mechanism transitions the wheels 26, 46 between a swiveling state and a directionally locked state. For example, in a swiveling state the wheels 26, 46 may be allowed to swivel freely which enables the roll-in cot 10 to be easily rotated. In the directionally locked state, the wheels 26, 46 may be actuated by an actuator (e.g., a solenoid actuator, a remotely operated servomechanism and the like) into a straight orientation, i.e., the front wheels 26 are oriented and locked in a straight direction and the back wheels 46 swivel freely such that an operator pushing from the back end 19 would direct the roll-in cot 10 forward.

Referring again to FIG. 1, the roll-in cot 10 may also comprise a cot actuation system comprising a front actuator 16 configured to move the front legs 20 and a back actuator 18 configured to move the back legs 40. The cot actuation system may comprise one unit (e.g., a centralized motor and pump) configured to control both the front actuator 16 and the back actuator 18. For example, the cot actuation system may comprise one housing with one motor capable to drive the front actuator 16, the back actuator 18, or both utilizing valves, control logic and the like. Alternatively as depicted in FIG. 1, the cot actuation system may comprise separate units configured to control the front actuator 16 and the back actuator 18 individually. In this embodiment, the front actuator 16 and the back actuator 18 may each include separate housings with individual motors to drive the actuators 16 or 18. While the actuators are shown as hydraulic actuators or chain lift actuators in the present embodiments, various other structures are contemplated as being suitable.

Referring to FIG. 1, the front actuator 16 is coupled to the support frame 12 and configured to actuate the front legs 20 and raise and/or lower the front end 17 of the roll-in cot 10. Additionally, the back actuator 18 is coupled to the support frame 12 and configured to actuate the back legs 40 and raise and/or lower the back end 19 of the roll-in cot 10. The cot actuation system may be motorized, hydraulic, or combinations thereof. Furthermore, it is contemplated that the roll-in cot 10 may be powered by any suitable power source. For example, the roll-in cot 10 may comprise a battery capable of supplying a voltage of, such as, about 24 V nominal or about 32 V nominal for its power source.

The front actuator 16 and the back actuator 18 are operable to actuate the front legs 20 and back legs 40, simultaneously or independently. As shown in FIGS. 5A-6E, simultaneous and/or independent actuation allows the roll-in cot 10 to be set to various heights.

Any actuator suitable to raise and lower the support frame 12 as well as retract the front legs 20 and back legs 40 is contemplated herein. As depicted in FIGS. 3 and 8, the front actuator 16 and/or the back actuator 18 may include chain lift actuators (e.g., chain lift actuators by Serapid, Inc. of Sterling Heights, Mich. U.S.A.). Alternatively, the front actuator 16 and/or the back actuator 18 may also include wheel and axle actuators, hydraulic jack actuators, hydraulic column actuators, telescopic hydraulic actuators electrical motors, pneumatic actuators, hydraulic actuators, linear actuators, screw actuators, and the like. For example, the actuators described herein may be capable of providing a dynamic force of about 350 pounds (about 158.8 kg) and a static force of about 500 pounds (about 226.8 kg). Furthermore, the front actuator 16 and the back actuator 18 may be operated by a centralized motor system or multiple independent motor systems.

In one embodiment, schematically depicted in FIGS. 1-2 and 7A-7B, the front actuator 16 and the back actuator 18 comprise hydraulic actuators for actuating the roll-in cot 10. In the embodiment depicted in FIG. 7A and FIG. 7B, the front actuator 16 and the back actuator 18 are dual piggy back hydraulic actuators. The dual piggy back hydraulic actuator comprises four hydraulic cylinders with four extending rods that are piggy backed (i.e., mechanically coupled) to one another in pairs. Thus, the dual piggy back actuator comprises a first hydraulic cylinder with a first rod, a second hydraulic cylinder with a second rod, a third hydraulic cylinder with a third rod and a fourth hydraulic cylinder with a fourth rod. Such hydraulic actuators are described in greater detail in commonly assigned U.S. Pat. No. 7,996,939.

While the cot actuation system is typically powered, the cot actuation system may also comprise a manual release component (e.g., a button, tension member, switch, linkage or lever) configured to allow an operator to raise or lower the front and back actuators 16, 18 manually. In one embodiment, the manual release component disconnects the drive units of the front and back actuators 16, 18 to facilitate manual operation. Thus, for example, the wheels 26, 46 may remain in contact with the ground when the drive units are disconnected and the roll-in cot 10 is manually raised. The manual release component may be disposed at various positions on the roll-in cot 10, for example, on the back end 19 or on the side of the roll-in cot 10.

To determine whether the roll-in cot 10 is level, sensors (not depicted) may be utilized to measure distance and/or angle. For example, the front actuator 16 and the back actuator 18 may each comprise encoders which determine the length of each actuator. In one embodiment, the encoders are real time encoders which are operable to detect movement of the total length of the actuator or the change in length of the actuator when the cot is powered or unpowered (i.e., manual control). While various encoders are contemplated, the encoder, in one commercial embodiment, may be the optical encoders produced by Midwest Motion Products, Inc. of Watertown, Minn. U.S.A. In other embodiments, the cot comprises angular sensors that measure actual angle or change in angle such as, for example, potentiometer rotary sensors, hall effect rotary sensors and the like. The angular sensors can be operable to detect the angles of any of the pivotingly coupled portions of the front legs 20 and/or the back legs 40. In one embodiment, angular sensors are operably coupled to the front legs 20 and the back legs 40 to detect the difference between the angle of the front leg 20 and the angle of the back leg 40 (angle delta). A loading state angle may be set to an angle such as about 20° or any other angle that generally indicates that the roll-in cot 10 is in a loading state (indicative of loading and/or unloading). Thus, when the angle delta exceeds the loading state angle the roll-in cot 10 may detect that it is in a loading state and perform certain actions dependent upon being in the loading state.

It is noted that the term "sensor," as used herein, means a device that measures a physical quantity and converts it into a signal which is correlated to the measured value of the physical quantity. Furthermore, the term "signal" means an electrical, magnetic or optical waveform, such as current, voltage, flux, DC, AC, sinusoidal-wave, triangular-wave, square-wave, and the like, capable of being transmitted from one location to another.

Referring now to FIG. 3, the front legs 20 may further comprise a front cross beam 22 extending horizontally between and moveable with the pair of front legs 20. The front legs 20 also comprise a pair of front hinge members 24 pivotingly coupled to the support frame 12 at one end and pivotingly coupled to the front legs 20 at the opposite end. Similarly, the pair of back legs 40 comprise a back cross beam 42 extending horizontally between and moveable with the pair of back legs 40. The back legs 40 also comprise a pair of back hinge members 44 pivotingly coupled to the support frame at one end and pivotingly coupled to one of the back legs 40 at the opposite end. In specific embodiments, the front hinge members 24 and the back hinge members 44 may be pivotingly coupled to the lateral side members 15 of the support frame 12. As used herein, "pivotingly coupled" means that two objects coupled together to resist linear motion and to facilitate rotation or oscillation between the objects. For example, front and back hinge members 24, 44 do not slide with the front and back carriage members 28, 48, respectively, but they rotate or pivot as the front and back legs 20, 40 are raised, lowered, retracted, or released. As shown in the embodiment of FIG. 3, the front actuator 16 may be coupled to the front cross beam 22, and the back actuator 18 may be coupled to the back cross beam 42.

Referring to FIG. 4, the front end 17 may also comprise a pair of front load wheels 70 configured to assist in loading the roll-in cot 10 onto a loading surface 500 (e.g., the floor of an ambulance). The roll-in cot 10 may comprise sensors operable to detect the location of the front load wheels 70 with respect to a loading surface 500 (e.g., distance above the surface or contact with the surface). In one or more embodiments, the front load wheel sensors comprise touch sensors, proximity sensors, or other suitable sensors effective to detect when the front load wheels 70 are above a loading surface 500. In one embodiment, the front load wheel sensors are ultrasonic sensors aligned to detect directly or indirectly the distance from the front load wheels to a surface beneath the load wheels. Specifically, the ultrasonic sensors, described herein, may be operable to provide an indication when a surface is within a definable range of distance from the ultrasonic sensor (e.g., when a surface is greater than a first distance but less than a second distance). Thus, the definable range may be set such that a positive indication is provided by the sensor when a portion of the roll-in cot 10 is in proximity to a loading surface 500.

In a further embodiment, multiple front load wheel sensors may be in series, such that the front load wheel sensors are activated only when both front load wheels 70 are within a definable range of the loading surface 500 (i.e., distance may be set to indicate that the front load wheels 70 are in contact with a surface). As used in this context, "activated" means that the front load wheel sensors send a signal to the control box 50 that the front load wheels 70 are both above the loading surface 500. Ensuring that both front load wheels 70 are on the loading surface 500 may be important, especially in circumstances when the roll-in cot 10 is loaded into an ambulance at an incline.

In the embodiments described herein, the control box 50 comprises or is operably coupled to a processor and a memory. The processor may be an integrated circuit, a microchip, a computer, or any other computing device capable of executing machine readable instructions. The electronic memory may be RAM, ROM, a flash memory, a hard drive, or any device capable of storing machine readable instructions. Additionally, it is noted that distance sensors may be coupled to any portion of the roll-in cot 10 such that the distance between a lower surface and components such as, for example, the front end 17, the back end 19, the front load wheels 70, the front wheels 26, the intermediate load wheels 30, the back wheels 46, the front actuator 16 or the back actuator 18 may be determined.

In further embodiments, the roll-in cot 10 has the capability to communicate with other devices (e.g., an ambulance, a diagnostic system, a cot accessory, or other medical equipment). For example, the control box 50 may comprise or may be operably coupled to a communication member operable to transmit and receive a communication signal. The communication signal may be a signal that complies with Controller Area Network (CAN) protocol, Bluetooth protocol, ZigBee protocol, or any other communication protocol.

The front end 17 may also comprise a hook engagement bar 80, which is typically disposed between the front load wheels 70, and is operable to swivel forward and backward. While the hook engagement bar 80 of FIG. 3 is U-shaped, various other structures such as hooks, straight bars, arc shaped bars, etc may also be used. As shown in FIG. 4, the hook engagement bar 80 is operable to engage with a loading surface hook 550 on a loading surface 500. Loading surface hooks 550 are commonplace on the floors of ambulances. The engagement of the hook engagement bar 80 and the loading surface hook 550 may prevent the roll-in cot 10 from sliding backwards from the loading surface 500. Moreover, the hook engagement bar 80 may comprise a sensor (not shown) which detects the engagement of the hook engagement bar 80 and the loading surface hook 550. The sensor may be a touch sensor, a proximity sensor, or any other suitable sensor operable to detect the engagement of the loading surface hook 550. In one embodiment, the engagement of the hook engagement bar 80 and the loading surface hook 550 may be configured to activate the front actuator 16 and thereby allow for retraction of the front legs 20 for loading onto the loading surface 500.

Referring still to FIG. 4, the front legs 20 may comprise intermediate load wheels 30 attached to the front legs 20. In one embodiment, the intermediate load wheels 30 may be disposed on the front legs 20 adjacent the front cross beam 22. Like the front load wheels 70, the intermediate load wheels 30 may comprise a sensor (not shown) which are operable to measure the distance the intermediate load wheels 30 are from a loading surface 500. The sensor may be a touch sensor, a proximity sensor, or any other suitable sensor operable to detect when the intermediate load wheels 30 are above a loading surface 500. As is explained in greater detail herein, the load wheel sensor may detect that the wheels are over the floor of the vehicle, thereby allowing the back legs 40 to safely retract. In some additional embodiments, the intermediate load wheel sensors may be in series, like the front load wheel sensors, such that both intermediate load wheels 30 must be above the loading surface 500 before the sensors indicate that the load wheels are above the loading surface 500 i.e., send a signal to the control box 50. In one embodiment, when the intermediate load wheels 30 are within a set distance of the loading surface the intermediate load wheel sensor may provide a signal which causes the control box 50 to activate the back actuator 18. Although the figures depict the intermediate load wheels 30 only on the front legs 20, it is further contemplated that intermediate load wheels 30 may also be disposed on the back legs 40 or any other position on the roll-in cot 10 such that the intermediate load wheels 30 cooperate with the front load wheels 70 to facilitate loading and/or unloading (e.g., the support frame 12).

Figure 9:
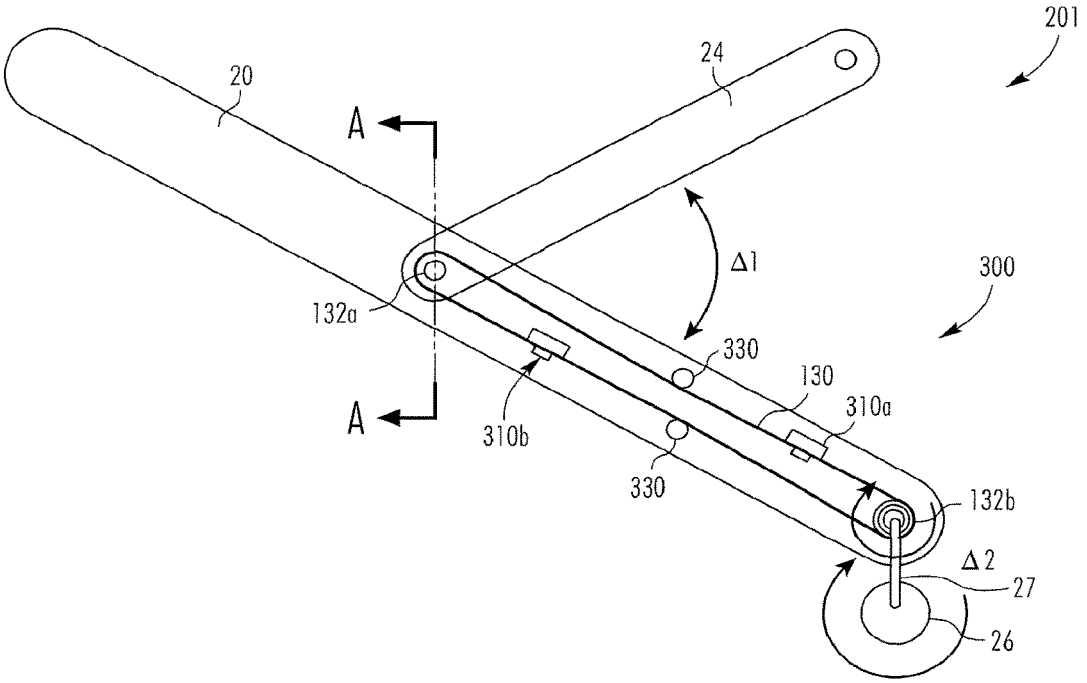
FIG. 9 schematically depicts a timing mechanism according to one or more embodiments shown or described herein.

Referring now to FIG. 9, in one embodiment the roll-in cot 10 comprises a wheel alignment mechanism 300. The wheel alignment mechanism 300 provides automatic vertical positioning of the front wheel linkage 27 as the front legs 20 are raised and lowered. By positioning the front wheel linkage 27 in the appropriate orientation, predictable rolling of the roll-in cot 10 can be achieved with the front legs 20 positioned in any of a variety of positions from fully raised to fully lowered, and intermediate positions therebetween. While specific discussion is made herein and describes positioning of the wheel alignment mechanism relative to the front legs 20 of the roll-in cot 10, it should be understood that a roll-in cot 10 according to the present disclosure may incorporate wheel alignment mechanisms 300 into any extendible leg assembly including, for example, back legs 40. Accordingly, "first" and "second" may be used interchangeably herein with "front" or "back" when describing the legs, hinge members, wheel linkages, and wheel alignment mechanisms of the roll-in cot 10 without regard to the positioning of a particular component.

As discussed hereinabove, the front leg 20 and the front hinge member 24 are coupled to one another and pivot relative to one another during raising and lowering operations of the front leg 20. The front leg 20 is coupled to the support frame 12 through a carriage 28 (FIG. 8), which allows the front leg 20 to slide in a longitudinal direction relative to the support frame 12 and rotate relative to the support frame 12. The front hinge member 24 is coupled to the support frame 12 and the front leg 20, and allowed to pivot relative to the support frame 12 and the front leg. Because the degrees of freedom of movement of the front leg 20 and the hinge member 24 are limited, the front leg 20 and the hinge member 24 move according to a pre-defined kinematic relationship relative to the support frame 12 and to each other when the front leg 20 undergoes a raising or lowering operation. This relative angular rotation between the front leg 20 and the hinge member 24 may be predictable and repeatable. In some embodiments, the relative angular rotation between the front leg 20 and the hinge member 24 may be generally constant (for example, within about 10%) over the stroke of front leg 20 as the front leg moves from a fully-retracted position to a fully-extended position. In other embodiments the relative angular rotation between the front leg 20 and the hinge member 24 may vary over the stroke of the front leg 20.

Because the angle of inclination of the front leg 20 relative to a ground surface changes between the fully-retracted position and the fully-extended position, the angular orientation of the front wheel linkage 27 relative to the ground surface varies as well. Wheel alignment mechanisms 300 according to the present disclosure maintain the angular inclination of the front wheel linkage 27 relative to the ground surface over the stroke of the front leg 20 as the front leg moves from a fully-retracted position to a fully-extended position.

As discussed hereinabove, the relative positioning and coupling of the support frame 12, the front leg 20, and the front hinge member 24 defines a kinematic relationship between the front leg 20 and the front hinge member 24 that causes the front leg 20 and the front hinge member 24 to move with relative angular rotation between one another as the front leg 20 moves between a fully-extended position and a fully-retracted position. This relative angular rotation between the front leg 20 and the front hinge member 24 may be calculated based on the positioning of the front leg 20 and the front hinge member 24 relative to the support frame 12. In general, the front hinge member 24 moves relative to the front leg 20 to a degree that is greater than the front leg 20 moves relative to the support frame 12. In the embodiment depicted in FIG. 9, the front hinge 20 moves at an average relative angular rotation to the front leg 20 that is about twice the movement of the front leg 20 relative to the support frame 12, when evaluated over the stroke of the front leg from the fully-retracted position to the fully-extended position. It should be understood, however, that roll-in cots 10 according to the present disclosure may incorporate a variety of relative angular rotation values. To maintain the relative angular inclination of the front wheel linkage 27 to the ground surface, the wheel alignment mechanism 300 may include elements that account for the relative angular rotation of the front leg 20 and the front hinge member 24.

In the embodiment depicted in FIG. 9, the wheel alignment mechanism 300 includes a timing member 130 disposed within at least a portion of a front leg 20. In the embodiment depicted in FIG. 9, the timing member 130 is a timing belt 131 that is frictionally engaged with hub set members that are positioned within the front leg 20. As will be discussed in greater detail below, the timing member 130 may have a variety of configurations. The timing belt 131 is engaged with hubs 132*a* and 132*b* that are pivotingly coupled to components of the front leg 20. A first hub 132*a* is coupled to the front hinge member 24, such that as the front leg 20 is raised and lowered, the first hub 132*a* is held fixed in position relative to the front hinge member 24 and rotates relative to the front leg 20. The first hub 132*a*, therefore, modifies the position of the timing belt 131 relative to the front leg 20 as the front leg 20 moves between a fully-raised position and a fully-lowered position.

A second hub 132*b* is coupled to the front wheel linkage 27. When the front leg 20 is raised and lowered, the second hub 132*b* is held fixed in position relative to the front wheel linkage 27 and rotates relative to the front leg 20. As the front leg 20 is raised and lowered, the timing belt 131 rotates the position of the front wheel linkage 27. The first hub 132*a* and the second hub 132*b*, therefore, modify the position of the timing belt to reposition the orientation of the front wheel linkage 27 as the front leg 20 moves between a fully-retracted position and a fully-lowered position.

The timing belt 131 and the first hub 132*a* and the second hub 132*b* may have a variety of mating interface configurations. In one embodiment, the timing belt 131, the first hub 132*a*, and the second hub 132*b* are grooved at their interface surfaces. However, alternative embodiments of the interface between the timing belt 131 and the first hub 132*a* and the second hub 132*b*, such as a flat interface or a "vee" interface, are contemplated. The timing belt 131 may be constructed from a variety of materials including polymers and elastomers. The timing belt 131 may also be reinforced with various materials that are conventionally known for increasing the strength and/or durability of belts, including nylon, polyester, aramids, and the like.

Figure 10:
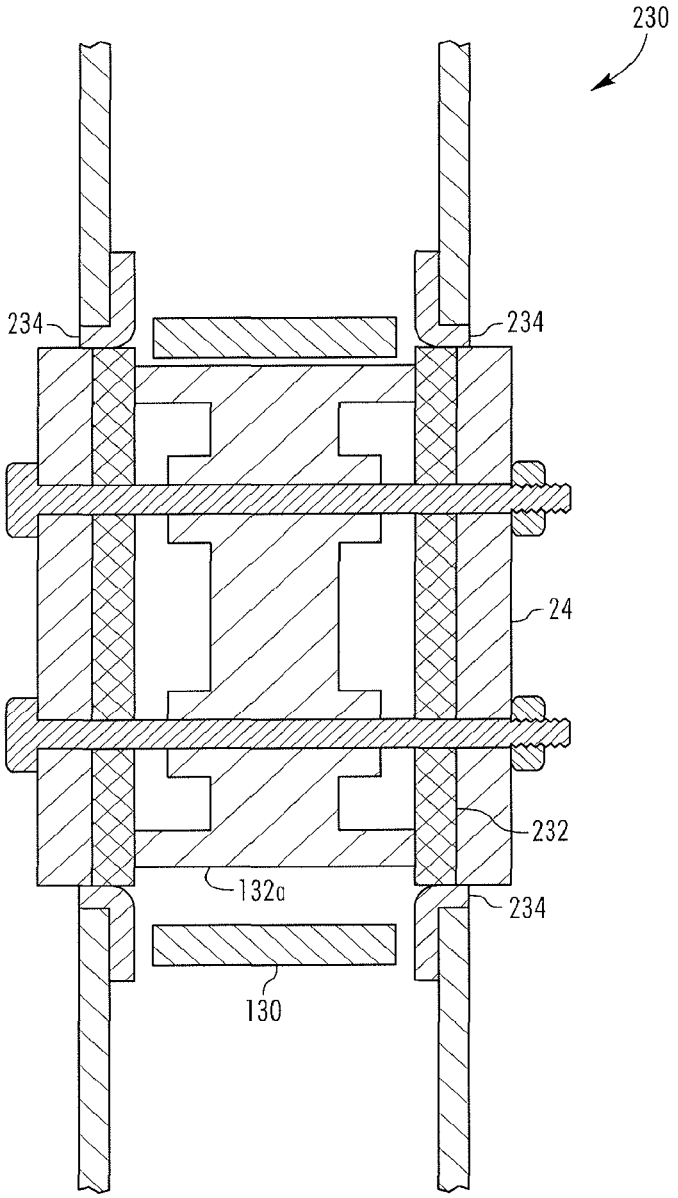
FIG. 10 schematically depicts a sectional view of the front leg of a cot along line A-A of FIG. 9 according to one or more embodiments shown or described herein.

Referring to FIG. 10, one embodiment of a hub portion 230 of the front leg 20 is depicted. The hub portion 230 provides the interface between the components of the hubs 132*a* and 132*b* and the front leg 20. As depicted in FIG. 10, the hub portion 230 connects the first hub 132*a* to the front hinge member 24 through the front leg 20. However, it should be understood that a similar hub portion may connect the second hub 132*b* to the front wheel linkage 27 (see FIG. 9). Referring again to FIG. 10, the hub portion 230 includes the first hub 132*a* which is partially encapsulated outer races 234. In some embodiments, the outer races 234 may be integrated into the front leg 20. The hub portion 230 may include a plurality of cover plates 232 that are positioned inside the outer races 234, thereby allowing the first hub 132*a* to rotate within the outer races 234. The front hinge member 24 is coupled to the first hub 132*a*, for example, by fasteners 238 passing through the front hinge member 24, the cover plates 232, and the first hub 132*a*. The hub portion 230 maintains alignment of the first hub 132*a* relative to the front hinge member 24, such that as the front hinge member 24 pivots relative to the front leg 20, the first hub 132*a* pivots relative to the upper leg 20 at the same rate as the front hinge member 24.

Referring again to FIG. 9, during a raising or lowering operation of the front leg 20, the front hinge member 24 pivots relative to the front leg 20, causing the first hub 132*a* to pivot with respect to the front leg 20. As the first hub 132*a*, which is engaged with the front hinge member 24, rotates, the timing belt 131 is drawn by the first hub 132*a* in one of two directions and communicates the rotation of the first hub 132*a* relative to the front leg 24 to the second hub 132*b*, which is similarly engaged with the timing belt 131. The second hub 132*b* is coupled to the front wheel linkage 27, such that rotation of the second hub 132*b* changes the orientation of the front wheel linkage 27 relative to the front leg 20.

In the embodiment depicted in FIG. 9, the first hub 132*a* has a smaller diameter than the second hub 132*b* such that the rotation of the first hub 132*a* is reduced as compared to the second hub 132*b*. The wheel alignment mechanism, therefore, has a reduction ratio that is equivalent to the ratio of the diameter of the first hub 132*a* to the second hub 132*b*. In the embodiment depicted in FIG. 9, the ratio of the diameter of the first hub 132*a* to the second hub 132*b* is approximately inverse to the relative angular motion between the front leg 20 and the front hinge member 24. Because the angular inclination of the front wheel linkage 27 is controlled by the front leg 24 and the front hinge member 24, as well as by the first hub 132*a* and the second hub 132*b* of the wheel alignment mechanism 300, maintaining an inverse relationship between the ratio of diameters of the first hub 132*a* and the second hub 132*b* and the relative angular motion between the front leg 20 and the front hinge member 24 may maintain an orientation of the front wheel linkage 27 relative to a horizontal ground surface as the front legs 20 move between a full-retracted position and a fully-extended position.

In the embodiment depicted in FIG. 9, the first hub 132*a* is about half the diameter of the second hub 132*b* that is coupled to the front wheel linkage 27. This corresponds to a front leg 20 and a front hinge member 24 that have a relative angular motion of about 2:1. A rotation $\Delta 1$ of the front hinge member 24 relative to the front leg 20 causes a rotation $\Delta 2$ of the front wheel linkage 27 relative to the front leg 20, where rotation $\Delta 2$ is half the magnitude of rotation $\Delta 1$. Restated, when the front hinge member 24 rotates 10° relative to the front leg 20, the front wheel linkage 27 will rotate 5° relative to the front leg 20, which is due to the relative size of the diameters of the first hub 132*a* and the second hub 132*b*.

While the wheel alignment mechanism 300 described hereinabove incorporates first hubs 132*a* and second hubs 132*b* having a diameter ratio of 1:2, it should be understood that any of a variety of diameter ratios of first hubs 132*a* and second hubs 132*b* may be selected to provide the desired ratio of rotation between the front hinge member 24 and the front wheel linkage 27. In some embodiments, the diameter ratio of the first hubs 132*a* and the second hubs 132*b* may be inverse to the relative angular rotation provided by the front leg 20 and the front hinge member 24. In some embodiments, the product of the diameter ratio of the first hubs 132*a* and the second hubs 132*b* and the relative angular rotation of the front leg 20 and the front hinge member 24 may be within about 30% of unity, including, for example, being within about 25% of unity, for example, being within about 20% of unity, for example, being within about 15% of unity, for example, being within about 10% of unity, for example, being within about 5% of unity. The lower the value of the product between the diameter ratio and the relative angular rotation may indicate that the relative angular inclination of the front wheel linkage 27 to a horizontal ground surface is more uniform through the stroke of the front leg 20 from the fully-retracted position to the fully-extended position. Accordingly, a roll-in cot 10 having the wheel alignment mechanisms 300 according to the present disclosure may have a front wheel linkage 27 that positions front wheels 26 in an angular inclination over a variety of orientations of the front legs 20.

Still referring to FIG. 9, the wheel alignment mechanism 300 may include a shock absorber 310 (as shown singularly in FIG. 11) or a plurality of shock absorbers 310*a*, 310*b* shown presently as a pair, where it will be appreciated that either variant is within the scope of the present disclosure such that the singular or plural nature of which will be apparent from the context. The shock absorber 310 is positioned relative to the timing belt 131 and reduces impact loading applied to the timing belt 131, for example when the front wheels 26 contact an obstacle.

Figure 11:
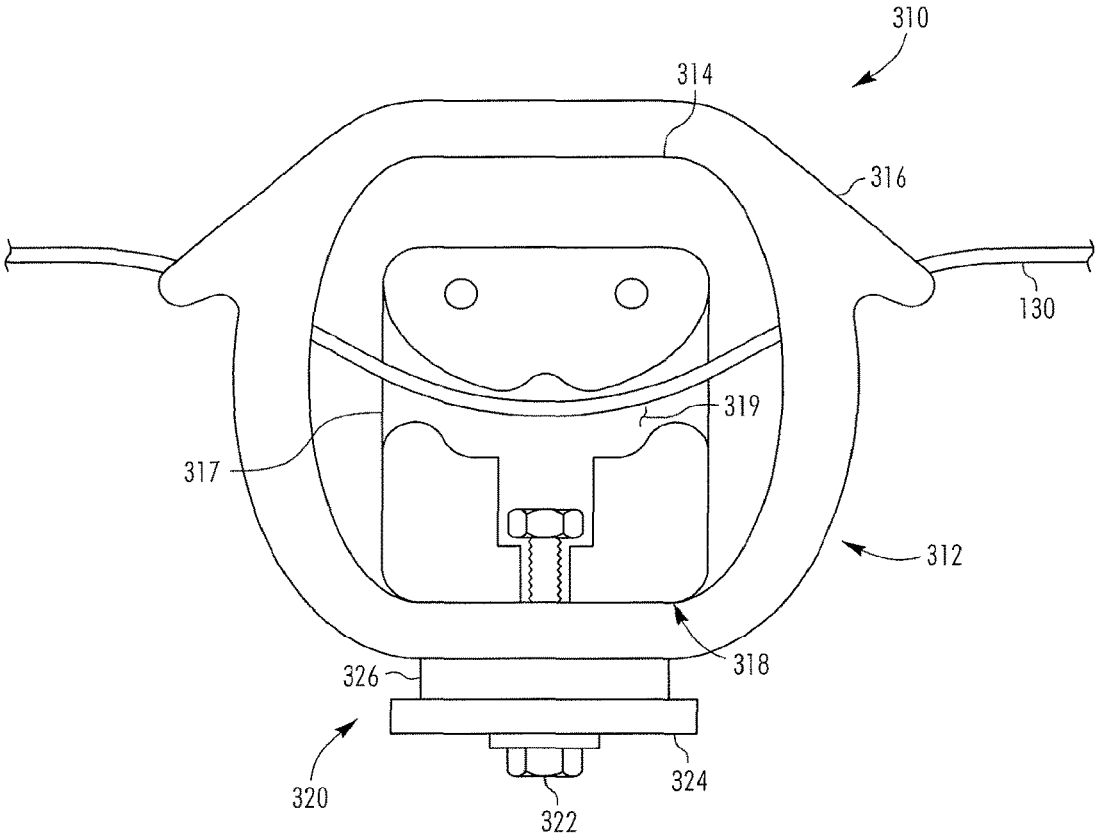
FIG. 11 schematically depicts a detailed side view of a wheel alignment mechanism including a shock absorber according to one or more embodiments shown or described herein.

Referring now to FIG. 11, a shock absorber is shown in greater detail. The shock absorber 310 includes a housing 312 having an opening 314 to accommodate a tensioner 318, and a belt relief channel 316. The tensioner 318 includes a belt channel 319 and is positioned within the opening 314 of the housing 312. The shock absorber 310 also includes a damping assembly 320 that includes a tension member 322, a load dispersing element 324, and a compliant bushing 326. In the embodiment depicted in FIG. 11, the tension member 322 is a threaded fastener that secures the damping assembly 320 to the follower 318. The shock absorber 310 may also include a plurality of cover plates 317 positioned along the outside of the housing 312 to enclose the shock absorber 310.

As depicted in FIG. 11, the tensioner 318 is positioned within the opening 314 of the housing 312, and the tensioner 318 is secured to the housing 312 by the tensioner member 322. The timing belt 131 is introduced along the belt relief 316 of the housing 312 and along the belt channel 319 of the tensioner 318. The path length of the timing belt 131 through the shock absorber 310 is greater than the linear distance along the belt relief 316 of the housing 312, such that the effective length of the timing belt 131 (i.e., the distance traveled by the timing belt 131 evaluated around the first hub 132*a* and the second hub 132*b*, as depicted in FIG. 9) is decreased upon installation of the shock absorber 310.

The damping assembly 320 of the shock absorber 310 includes a compliant bushing 326. The compliant bushing 326 may be made from a variety of materials including natural or synthetic elastomers. In another embodiment, at least one mechanical spring (not shown) may be arranged within the shock absorber 310 and perform the same functions as the compliant bushing 326 discussed herein. Further, the tension member 322 may be adjusted to provide a pre-determined deformation of the compliant bushing 326, such that variations in the size or material properties of the compliant bushing 326 can be accommodated without adversely affecting performance of the shock absorber 310.

As discussed hereinabove, the front wheel linkage 27 of the roll-in cot 10 is configured to be repositionable in its vertical orientation, such that alignment of the front wheels 26 is maintained over a variety of positions of the front legs 20. In operation of the roll-in cot 10, when the front wheels 26 contact an obstacle, for example, when the roll-in cot 10 is being moved, contact between the front wheels 26 and the obstacle may tend to shift the vertical orientation of the front wheel linkage 27 relative to the front legs 20. Rotational orientation of the front wheel linkage 27 is arrested by the interaction between the second hub 132*b*, the timing belt 131, the first hub 132*a*, and the front hinge member 24. However, impact between the front wheels 26 and an obstacle may induce a force into the timing belt 131. The magnitude of the force may tend to overload the timing belt 131, if the timing belt 131 is not fitted with a shock absorber 310 as discussed hereinabove.

When a load is applied to the damping assembly 320 that tends to draw the load dispersing element 324 in a direction towards the housing 312, the compliant bushing 326 deforms. When an impulse load is applied to the timing belt 131 in an orientation that tends to increase the path length of the timing belt 131, the timing belt 131 positioned within the shock absorber 310 tends to "straighten" such that the tensioner 318 draws the load dispersing element 324 in a direction towards the housing 312. As the load dispersing element 324 translates towards the housing 312, the compliant bushing 326 deforms, thereby absorbing at least a portion of the impulse load. By absorbing at least a portion of the impulse load applied to the front wheels 26 at the compliant bushing 326, impulse load directed into the timing belt 131 may be mitigated, thereby reducing the likelihood of an overload condition of the timing belt 131.

The material, cross-sectional area, and thickness of the compliant bushing 326 may be selected such that a pre-determined impulse load, for example, an impact load associated with one of the front wheels 26 contacting an obstacle such as a curb while the roll-in cot 10 is moving at a brisk walking pace with a patient weighing 550 pounds positioned in a supine position on the roll-in cot 10 will tend to deform the compliant bushing 326 without a tensile overload of the timing belt 131. In particular, timing belt 131 may be designed to have a safety factor of approximately 50% over this load case such that in the event of the introduction of such an impact event as described hereinabove, the timing belt 131 will maintain structural integrity. Further, when the timing belt 131 of the roll-in cot 10 is fitted with a shock absorber 310, components of the shock absorber 310 deform to dissipate force in the timing belt 131 associated with the front wheels 26 impacting an obstacle.

As previously mentioned, embodiments of the roll-in cot 10 may include a plurality of shock absorbers 310*a*, 310*b* positioned along opposite sides of the timing belt 131. In the embodiment depicted in FIG. 9, the upper shock absorber 310*a* will absorb impact loads associated with the roll-in cot 10 moving in a forward direction (i.e., loads that tend to increase the length of the timing belt 131 positioned relative to the upper shock absorber 310*a*), while the lower shock absorber 310*b* will absorb impact loads associated with the roll-in cot 10 moving in a rearwards direction (i.e., loads that tend to increase the_length of the timing belt 131 positioned relative to the lower shock absorber 310*b*).

Still referring to FIG. 9, the wheel alignment mechanism 300 may also include at least one idler roller 330. The idler roller 330 contacts the timing belt 131 and allows the timing belt 131 to change planar orientations, such that the timing belt 131 may continue to engage the first hub 132*a* and the second hub 132*b* in applications in which the first hub 132*a* and the second hub 132*b* do not have line-of-sight clearance. In some embodiments, the idler roller 330 may include a roller mounted on a bearing that is secured to the front leg 20 and configured to rotate while imputing minimum friction to the wheel alignment mechanism 300.

In further embodiments, both of the front legs 20 comprise a wheel alignment mechanism 300 as discussed hereinabove. In such embodiments, raising or lowering the front end 17 of the support frame 12 by the front legs 20 trigger the rotation of the front wheel linkage 27. Additionally, the back legs 40 may comprise a wheel alignment mechanism 300 similar to that discussed in regard to the front legs 20, wherein the raising or lowering of the back end 19 of the support frame 12 by the back legs 40 triggers the rotation of the back wheel linkage 47. Thus in embodiments where each of the front legs 20 and the back legs 40 both comprise wheel alignment mechanisms 300, vertical orientation of the front wheels 26 and back wheels 46 can be maintained to ensure that the roll-in cot 10 can roll across surfaces of various cot heights. Thus, the roll-in cot 10 may be rolled in the fore/aft direction and/or side to side at any height when the support frame 12 is substantially parallel to the ground, i.e., the front legs 20 and the back legs 40 are actuated to substantially the same length. Further, by maintaining the vertical orientation of the front wheel linkage 27 and the back wheel linkage 47 relative to the ground, the roll-in cot 10 may be rolled in the fore/aft direction and/or side to side when the support frame 12 is substantially parallel to the ground, and the front legs 20 and the back legs 40 are actuated to different lengths.

Figure 12A:
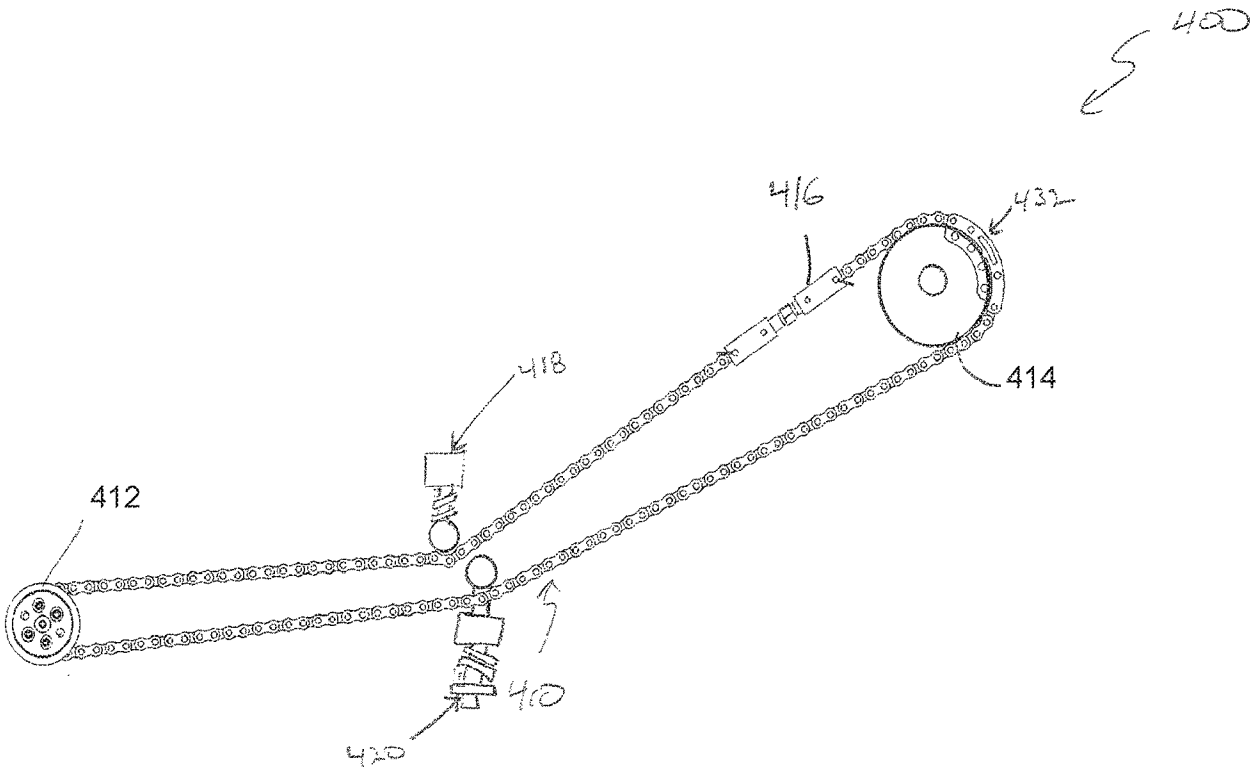
FIG. 12*a* schematically depicts a detailed side view of a timing mechanism for one of the front legs or rear legs of a roll-in cot according to one or more embodiments shown or described herein.

Referring now to FIG. 12*a*, other embodiments of the roll-in cot may include a wheel alignment mechanism 400 having a timing mechanism 130 that is a timing chain 410. The timing chain 410 is coupled to a first hub 414 positioned proximate to the support frame (shown in FIG. 1) and a second hub 412 positioned proximate to one of the front wheels or the rear wheels (shown in FIG. 1). The first hub 414 and the second hub 412 are positioned within one of the front legs or the rear legs (shown in FIG. 1) of the roll-in cot. Similar to the embodiment of the roll-in cot incorporating the timing belt described hereinabove in regard to FIGS. 9-11, the timing chain 410 maintains the rotational orientation of the front wheels or the rear wheels relative to the support frame of the roll-in cot so that the rotational clocking orientation of the wheels relative to the ground surface upon which the roll-in cot traverses is maintained for all orientations of the front legs or the rear legs through their range of motion. In various embodiments of the roll-in cot, the first hub 414 may be positioned at a variety of positions along the front or rear legs. Rotation of the first hub 414 may account for the positioning of the first hub 414 as to maintain the rotational clocking orientation of the wheels of the roll-in cot. Maintaining the radial orientation of the front wheels and the rear wheels may assist with mobility of the roll-in cot when the legs are positioned in a variety of orientations. In one embodiment, steering of the roll-in cot may be adversely affected if the front wheels or the rear wheels are rotated out of alignment. Maintaining alignment of the front wheels and the rear wheels, therefore, may improve the handling characteristics of the roll-in cot.

Still referring to FIG. 12*a*, the alignment mechanism 400 includes the timing chain 410 coupled to both the first hub 414 and the second hub 412. The timing chain 410 includes a link coupler 416 that joins the timing chain 410 onto itself so that the timing chain 410 is continuous around its perimeter. The link coupler 416 may adjust the length of the timing chain 410 so that the timing chain 410 may be adjusted to accommodate variations in distance between the first hub 414 and the second hub 412.

The alignment mechanism 410 may also include chain tensioners 418, 420 that modify the position of the timing chain 410 as to increase the path distance of the timing chain 410 evaluated around the first hub 414 and the second hub 412. By increasing the path distance of the timing chain 410 around the first hub 414 and the second hub 412, the effective length of the timing chain 410 may be reduced, thereby increasing tension on the timing chain 410. In some embodiments, the chain tensioners 418, 420 may include a spring mechanism that automatically modifies the path length of the timing chain 410 to account for relative translational movement between the first hub 414 and the second hub 412. In embodiment in which the chain tensioners 418, 410 include spring mechanisms, the chain tensioners 418, 420 may absorb shock loads imparted to the timing chain 410 by temporarily allowing the timing chain 410 to translate the chain tensioner 418, 420, thereby temporarily decreasing the path length of the timing chain 410.

Figure 12B:
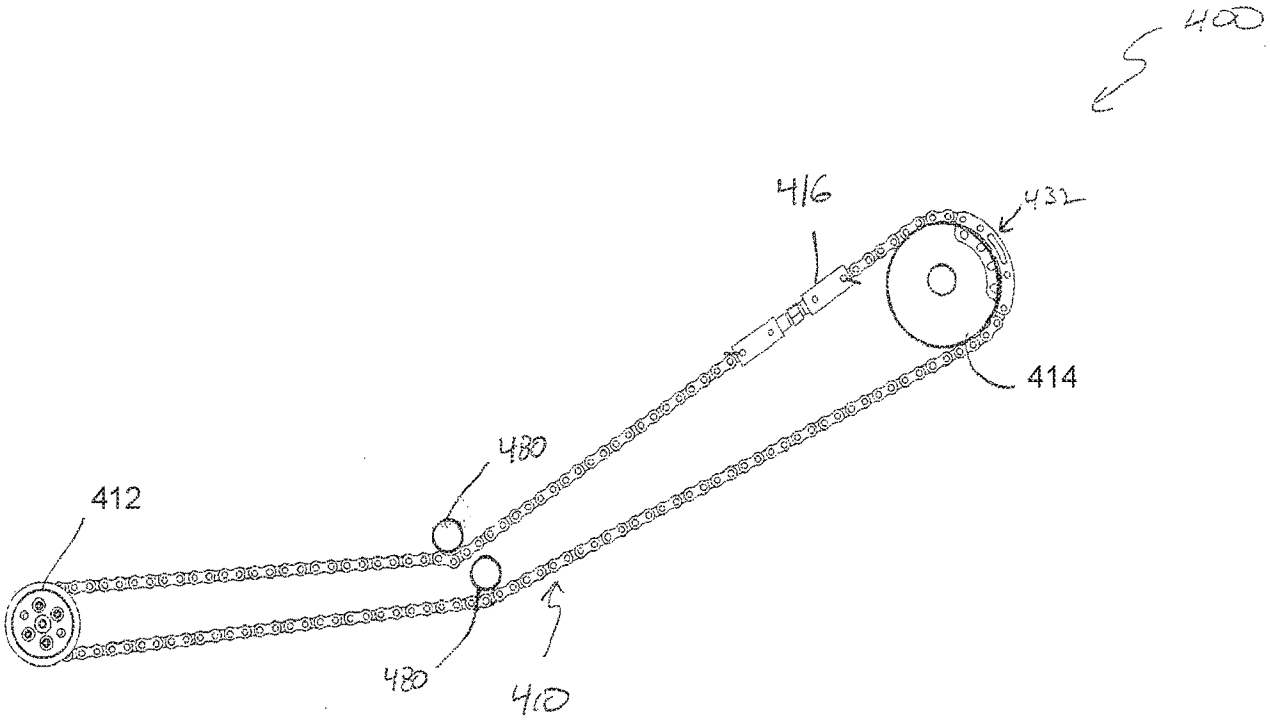
FIG. 12*b* schematically depicts a detailed side view of a timing mechanism for one of the front legs or rear legs of a roll-in cot according to one or more embodiments shown or described herein.

Referring now to FIG. 12*b*, other embodiments of the roll-in cot 10 may include an alignment mechanism 410 having idler rollers 480 (analogous to the idler rollers 330 described hereinabove) that modify the orientation of the timing chain 410 but do not actively modify the tension induced into the timing chain 410. The idler rollers 480 may position the timing chain 410 to avoid contact with elements of the cot legs to prevent inadvertent contact between the timing chain 410 and the cot legs.

Figure 13:
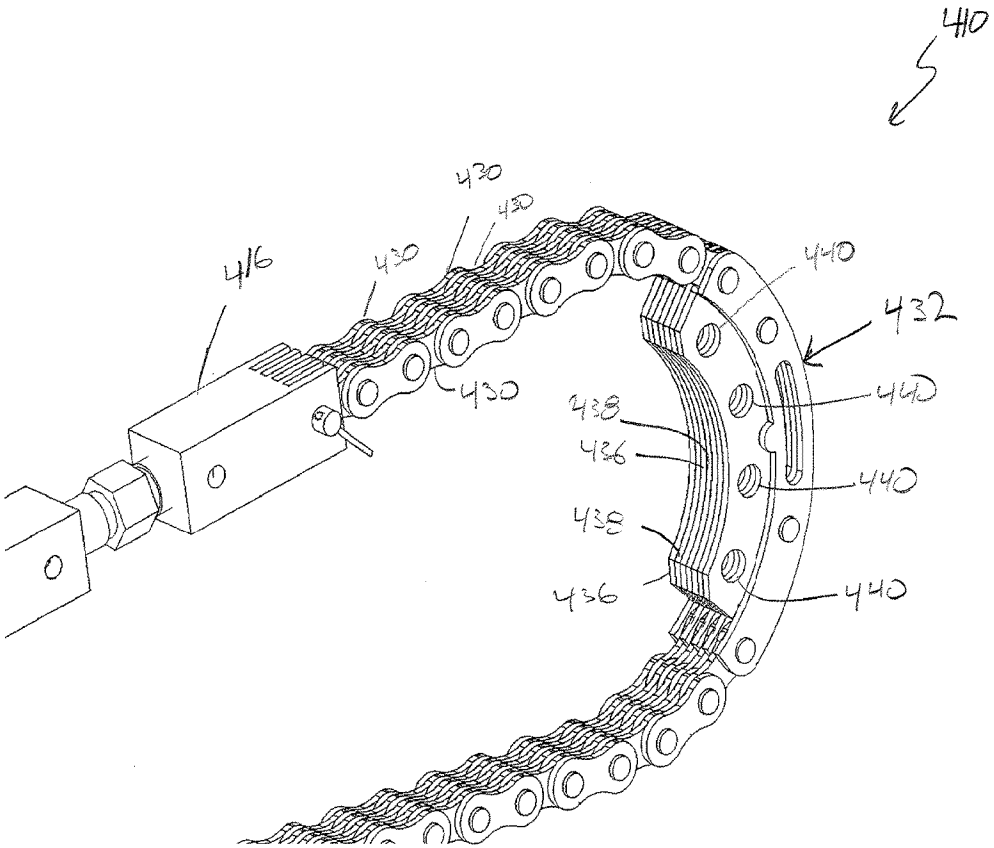
FIG. 13 schematically depicts a side perspective view of a portion of a timing mechanism for one of the front legs or rear legs of a roll-in cot according to one or more embodiments shown or described herein.

Referring now to FIG. 13, a detail view of the timing chain 410 is depicted. In the depicted embodiment, the timing chain 410 includes a plurality of links 430 adjoined to one another to form the timing chain 410. In the embodiment depicted in FIG. 13, the timing chain 410 is a block chain, however other types of chains may be suitable for the instant design without departing from the scope of the present disclosure, including roller chains. In the embodiment depicted in FIG. 13, the timing chain 410 is generally fixed in orientation to the first hub 414 and the second hub 412 (see FIG. 12*a* and FIG. 12*b*) to maintain the rotational clocking orientations of the first hub 414 and the second hub 412. Therefore, the orientation of the timing chain 410 relative to the first hub 414 and the second hub 412 is generally fixed so that the meshing of the timing chain 410 with the first hub 414 and the second hub 412 is not modified. However, other embodiments of the alignment mechanism 400 may incorporate first and second hubs 414, 412 and a timing chain 410 whose meshing is modified over in operation.

The timing chain 410 includes a first hub mating portion 432 that is coupled to the first hub 414 (shown in FIG. 12*a* and FIG. 12*b*). The first hub mating portion 432 includes a plurality of attachment plates 436, 438 that are pinned to one another to form the first hub mating portion 432. The attachment plates 436, 438 correspond in general thickness to the links 430 that make up remaining portions of the timing chain 410, so that the first hub mating portion 432 may be easily integrated into the timing chain 410. Each of the attachment plates 436, 438 include at least one through hole 440 that passes through the attachment plates 436, 438. When the attachment plates 436, 438 are aligned and assembled into the first hub mating portion 432, the through holes 440 are aligned to allow insertion of a fastener, for example a bolt, screw, or pin. The first hub mating portion 432 may thereby be resiliently coupled to the first hub 414 through a fastened connection.

Figure 14:
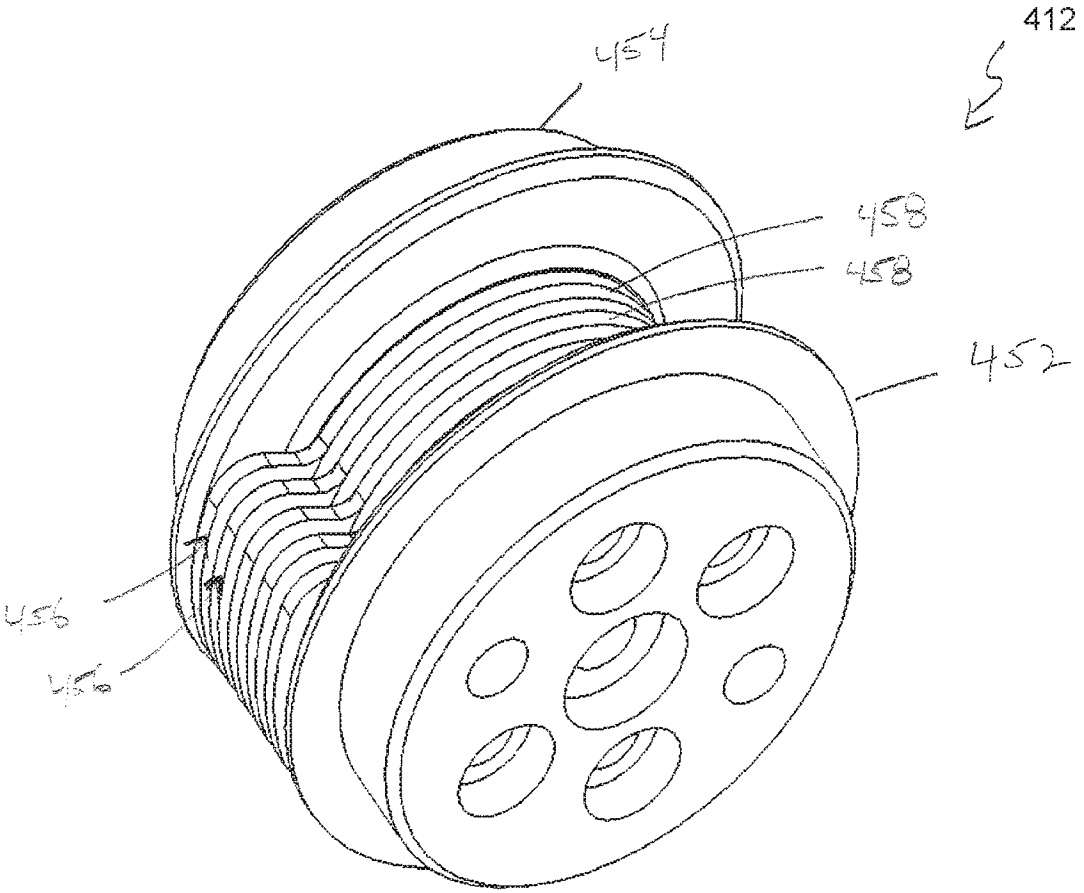
FIG. 14 schematically depicts a side perspective view of a hub for a timing mechanism for one of the front legs or rear legs of a roll-in cot according to one or more embodiments shown or described herein.
Figure 15:
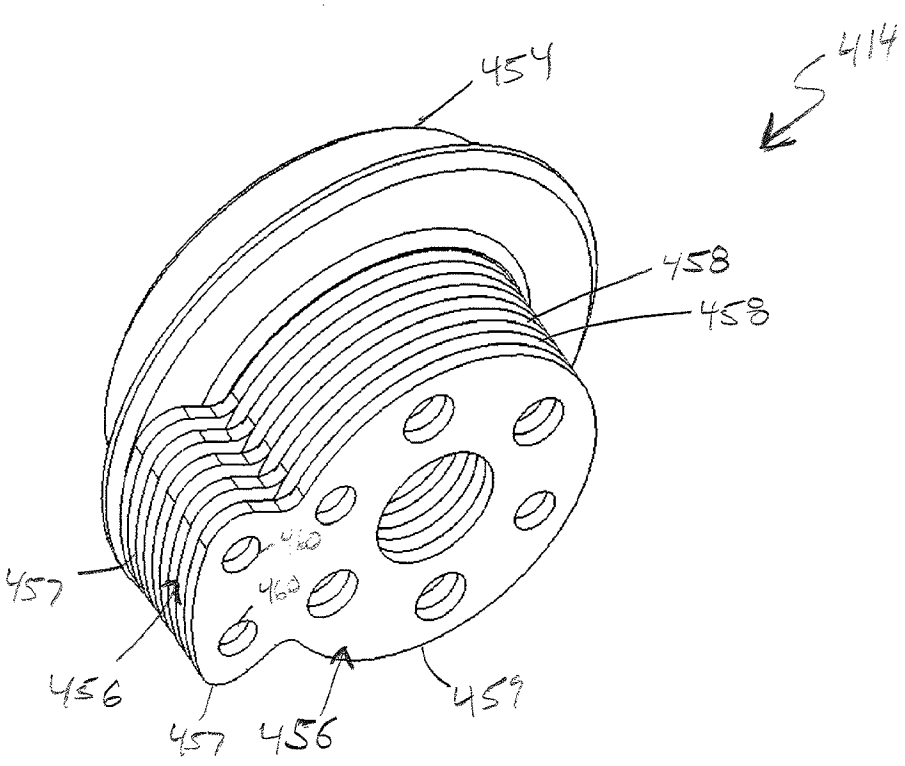
FIG. 15 schematically depicts a side perspective view of a hub for a timing mechanism with certain components removed for clarity according to one or more embodiments shown or described herein.

Referring now to FIGS. 14 and 15, one embodiment of the second hub 412 is depicted. Referring to FIG. 14, the second hub 412 includes a first cover plate 452 and a second cover plate 454 that are positioned opposite one another along the ends of the second hub 412. The second hub 412 also includes a plurality of attachment plates 456 and bypass plates 458 that are arranged proximate to one another to form the center portion of the second hub 412. The first cover plate 452 of the second hub 412 is removed from the view of FIG. 15 to more clearly depict the attachment plates 456 and the bypass plates 458 of the second hub 412.

Referring now to FIG. 15, the attachment plates 456 of the second hub 412 each include a securement tab 457 that extends from a clearance portion 459. The securement tabs 457 each include at least one through hole 460 through which a fastener, such as a screw, a bolt, or a pin, may be inserted. When the plurality of attachment plates 456 and the plurality of bypass plates 458 are assembled and arranged with one another, the links 430 of the timing chain 410 may be inserted into the clearance zones in the second hub 412 created by the bypass plates 458 so that at least some of the links 430 may be coupled to the attachment plates 456. Coupling the timing chain 410 and the attachment plates 456 of the second hub 412 to one another provides a resilient attachment between the timing chain 410 and the second hub 412, thereby allowing the timing chain 410 to maintain the rotational clocking orientation of the first hub 414 and the second hub 412.

While specific reference has been made herein to the attachment schemes of the timing chain 410 to the first hub 414 and the second hub 412, it should be understood that these attachment schemes may be modified or altered to suit a particular end-user application without departing from the scope of the present disclosure.

Referring again to FIG. 3, the roll-in cot 10 may comprise a front actuator sensor 62 and a back actuator sensor 64 configured to detect whether the front and back actuators 16, 18 respectively are under tension or compression. As used herein, the term "tension" means that a pulling force is being detected by the sensor. Such a pulling force is commonly associated with the load being removed from the legs coupled to the actuator, i.e., the leg and or wheels are being suspended from the support frame 12 without making contact with a surface beneath the support frame 12. Furthermore, as used herein the term "compression" means that a pushing force is being detected by the sensor. Such a pushing force is commonly associated with a load being applied to the legs coupled to the actuator, i.e., the leg and or wheels are in contact with a surface beneath the support frame 12 and transfer a compressive strain on the coupled actuator. In one embodiment, the front actuator sensor 62 and the back actuator sensor 64 are coupled to the support frame 12; however, other locations or configurations are contemplated herein. The sensors may be proximity sensors, strain gauges, load cells, Hall-effect sensors, or any other suitable sensor operable to detect when the front actuator 16 and/or back actuator 18 are under tension or compression. In further embodiments, the front actuator sensor 62 and the back actuator sensor 64 may be operable to detect the weight of a patient disposed on the roll-in cot 10 (e.g., when strain gauges are utilized).

Referring to FIGS. 1-4, the movement of the roll-in cot 10 may be controlled via the operator controls. Referring again to the embodiment of FIG. 1, the back end 19 may comprise operator controls for the roll-in cot 10. As used herein, the operator controls are the components used by the operator in the loading and unloading of the roll-in cot 10 by controlling the movement of the front legs 20, the back legs 40, and the support frame 12. Referring to FIG. 2, the operator controls may comprise one or more hand controls 57 (for example, buttons on telescoping handles) disposed on the back end 19 of the roll-in cot 10. Moreover, the operator controls may include a control box 50 disposed on the back end 19 of the roll-in cot 10, which is used by the cot to switch from the default independent mode and the synchronized or "sync" mode. The control box 50 may comprise one or more buttons 54, 56 which place in the cot in sync mode, such that both the front legs 20 and back legs 40 can be raised and lowered simultaneously. In a specific embodiment, the sync mode may only be temporary and cot operation will return to the default mode after a period of time, for example, about 30 seconds. In a further embodiment, the sync mode may be utilized in loading and/or unloading the roll-in cot 10. While various positions are contemplated, the control box may be disposed between the handles on the back end 19.

As an alternative to the hand control embodiment, the control box 50 may also include a component which may be used to raise and lower the roll-in cot 10. In one embodiment, the component is a toggle switch 52, which is able to raise (+) or lower (−) the cot. Other buttons, switches, or knobs are also suitable. Due to the integration of the sensors in the roll-in cot 10, as is explained in greater detail herein, the toggle switch 52 may be used to control the front legs 20 or back legs 40 which are operable to be raised, lowered, retracted or released depending on the position of the roll-in cot 10. In one embodiment the toggle switch is analog (i.e., the pressure and/or displacement of the analog switch is proportional to the speed of actuation). The operator controls may comprise a visual display component 58 configured to inform an operator whether the front and back actuators 16, 18 are activated or deactivated, and thereby may be raised, lowered, retracted or released. While the operator controls are disposed at the back end 19 of the roll-in cot 10 in the present embodiments, it is further contemplated that the operator controls be positioned at alternative positions on the support frame 12, for example, on the front end 17 or the sides of the support frame 12. In still further embodiments, the operator controls may be located in a removably attachable wireless remote control that may control the roll-in cot 10 without physical attachment to the roll-in cot 10.

In other embodiments as shown in FIG. 4, the roll-in cot 10 may further comprise a light strip 140 configured to illuminate the roll-in cot 10 in poor lighting or poor visibility environments. The light strip 140 may comprise LED's, light bulbs, phosphorescent materials, or combinations thereof. The light strip 140 may be triggered by a sensor which detects poor lighting or poor visibility environments. Additionally, the cot may also comprise an on/off button or switch for the light strip 140. While the light strip 140 is positioned along the side of the support frame 12 in the embodiment of FIG. 4, it is contemplated that the light strip 140 could be disposed on the front and/or back legs 20, 40, and various other locations on the roll-in cot 10. Furthermore it is noted that the light strip 140 may be utilized as an emergency beacon analogous to ambulance emergency lights. Such an emergency beacon is configured to sequence the warning lights in a manner that draws attention to the emergency beacon and that mitigates hazards such as, for example photosensitive epilepsy, glare and phototaxis.

Turning now to embodiments of the roll-in cot 10 being simultaneously actuated, the cot of FIG. 4 is depicted as extended, thus front actuator sensor 62 and back actuator sensor 64 detect that the front actuator 16 and the back actuator 18 are under compression, i.e., the front legs 20 and the back legs 40 are in contact with a lower surface and are loaded. The front and back actuators 16 and 18 are both active when the front and back actuator sensors 62, 64 detect both the front and back actuators 16, 18, respectively, are under compression and can be raised or lowered by the operator using the operator controls as shown in FIG. 2 (e.g., "–" to lower and "+" to raise).

Figure 5A:
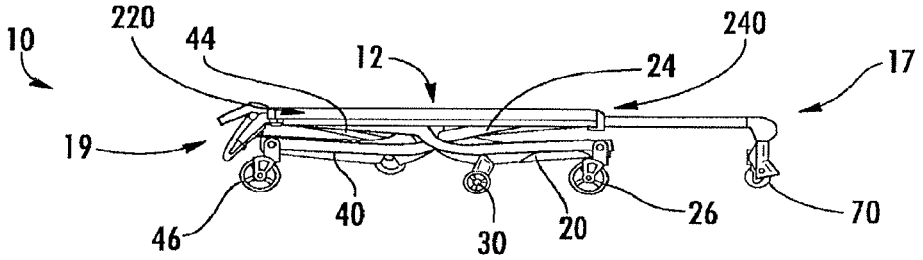
FIGS. 5A-5C is a side view depicting a raising and/or lower sequence of a cot according to one or more embodiments shown or described herein.
Figure 5B:
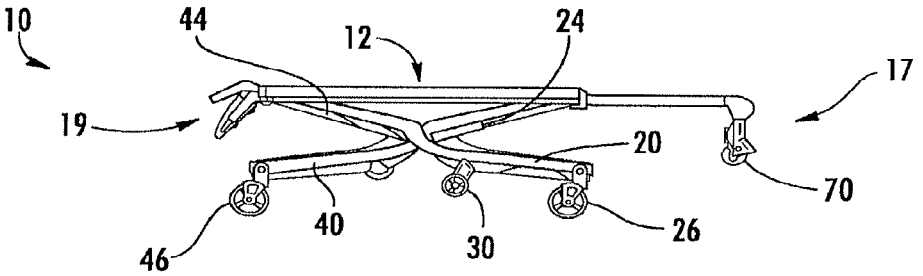
Figure 5C:
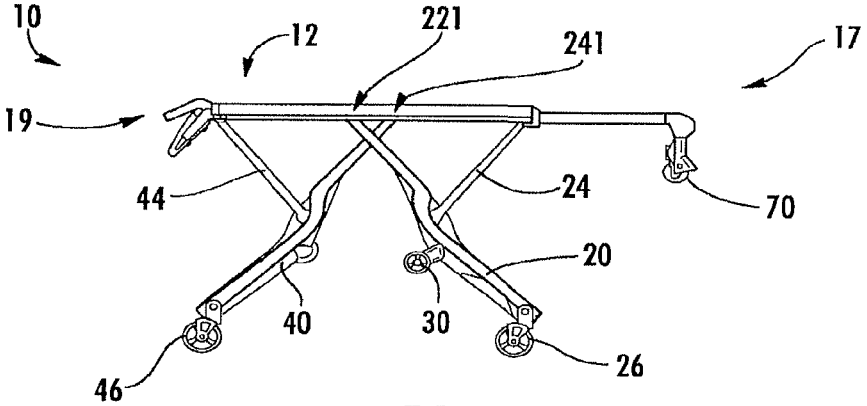

Referring collectively to FIGS. 5A-5C, an embodiment of the roll-in cot 10 being raised (FIGS. 5A-5C) or lowered (FIGS. 5C-5A) via simultaneous actuation is schematically depicted (note that for clarity the front actuator 16 and the back actuator 18 are not depicted in FIGS. 5A-5C). In the depicted embodiment, the roll-in cot 10 comprises a support frame 12 slidingly engaged with a pair of front legs 20 and a pair of back legs 40. Each of the front legs 20 are rotatably coupled to a front hinge member 24 that is rotatably coupled to the support frame 12 (e.g., via carriage members 28, 48 (FIG. 8)). Each of the back legs 40 are rotatably coupled to a back hinge member 44 that is rotatably coupled to the support frame 12. In the depicted embodiment, the front hinge members 24 are rotatably coupled towards the front end 17 of the support frame 12 and the back hinge members 44 that are rotatably coupled to the support frame 12 towards the back end 19.

FIG. 5A depicts the roll-in cot 10 in a lowest transport position (e.g., the back wheels 46 and the front wheels 26 are in contact with a surface, the front leg 20 is slidingly engaged with the support frame 12 such that the front leg 20 contacts a portion of the support frame 12 towards the back end 19 and the back leg 40 is slidingly engaged with the support frame 12 such that the back leg 40 contacts a portion of the support frame 12 towards the front end 17). FIG. 5B depicts the roll-in cot 10 in an intermediate transport position, i.e., the front legs 20 and the back legs 40 are in intermediate transport positions along the support frame 12. FIG. 5C depicts the roll-in cot 10 in a highest transport position, i.e., the front legs 20 and the back legs 40 positioned along the support frame 12 such that the front load wheels 70 are at a maximum desired height which can be set to height sufficient to load the cot, as is described in greater detail herein.

The embodiments described herein may be utilized to lift a patient from a position below a vehicle in preparation for loading a patient into the vehicle (e.g., from the ground to above a loading surface of an ambulance). Specifically, the roll-in cot 10 may be raised from the lowest transport position (FIG. 5A) to an intermediate transport position (FIG. 5B) or the highest transport position (FIG. 5C) by simultaneously actuating the front legs 20 and back legs 40 and causing them to slide along the support frame 12. When being raised, the actuation causes the front legs to slide towards the front end 17 and to rotate about the front hinge members 24, and the back legs 40 to slide towards the back end 19 and to rotate about the back hinge members 44. Specifically, a user may interact with a control box 50 (FIG. 2) and provide input indicative of a desire to raise the roll-in cot 10 (e.g., by pressing "+" on toggle switch 52). The roll-in cot 10 is raised from its current position (e.g., lowest transport position or an intermediate transport position) until it reaches the highest transport position. Upon reaching the highest transport position, the actuation may cease automatically, i.e., to raise the roll-in cot 10 higher additional input is required. Input may be provided to the roll-in cot 10 and/or control box 50 in any manner such as electronically, audibly or manually.

The roll-in cot 10 may be lowered from an intermediate transport position (FIG. 5B) or the highest transport position (FIG. 5C) to the lowest transport position (FIG. 5A) by simultaneously actuating the front legs 20 and back legs 40 and causing them to slide along the support frame 12. Specifically, when being lowered, the actuation causes the front legs to slide towards the back end 19 and to rotate about the front hinge members 24, and the back legs 40 to slide towards the front end 17 and to rotate about the back hinge members 44. For example, a user may provide input indicative of a desire to lower the roll-in cot 10 (e.g., by pressing a "–" on toggle switch 52). Upon receiving the input, the roll-in cot 10 lowers from its current position (e.g., highest transport position or an intermediate transport position) until it reaches the lowest transport position. Once the roll-in cot 10 reaches its lowest height (e.g., the lowest transport position) the actuation may cease automatically. In some embodiments, the control box 50 (FIG. 1) provides a visual indication that the front legs 20 and back legs 40 are active during movement.

In one embodiment, when the roll-in cot 10 is in the highest transport position (FIG. 5C), the front legs 20 are in contact with the support frame 12 at a front-loading index 221 and the back legs 40 are in contact with the support frame 12 a back-loading index 241. While the front-loading index 221 and the back-loading index 241 are depicted in FIG. 5C as being located near the middle of the support frame 12, additional embodiments are contemplated with the front-loading index 221 and the back-loading index 241 located at any position along the support frame 12. For example, the highest transport position may be set by actuating the roll-in cot 10 to the desired height and providing input indicative of a desire to set the highest transport position (e.g., pressing and holding the "+" and "–" on toggle switch 52 simultaneously for 10 seconds).

In another embodiment, any time the roll-in cot 10 is raised over the highest transport position for a set period of time (e.g., 30 seconds), the control box 50 provides an indication that the roll-in cot 10 has exceeded the highest transport position and the roll-in cot 10 needs to be lowered. The indication may be visual, audible, electronic or combinations thereof.

When the roll-in cot 10 is in the lowest transport position (FIG. 5A), the front legs 20 may be in contact with the support frame 12 at a front-flat index 220 located near the back end 19 of the support frame 12 and the back legs 40 may be in contact with the support frame 12 a back-flat index 240 located near the front end 17 of the support frame 12. Furthermore, it is noted that the term "index," as used herein means a position along the support frame 12 that corresponds to a mechanical stop or an electrical stop such as, for example, an obstruction in a channel formed in a lateral side member 15, a locking mechanism, or a stop controlled by a servomechanism.

The front actuator 16 is operable to raise or lower a front end 17 of the support frame 12 independently of the back actuator 18. The back actuator 18 is operable to raise or lower a back end 19 of the support frame 12 independently of the front actuator 16. By raising the front end 17 or back end 19 independently, the roll-in cot 10 is able to maintain the support frame 12 level or substantially level when the roll-in cot 10 is moved over uneven surfaces, for example, a staircase or hill. Specifically, if one of the front legs 20 or the back legs 40 is in tension, the set of legs not in contact with a surface (i.e., the set of legs that is in tension) is activated by the roll-in cot 10 (e.g., moving the roll-in cot 10 off of a curb). Further embodiments of the roll-in cot 10 are operable to be automatically leveled. For example, if back end 19 is lower than the front end 17, pressing the "+" on toggle switch 52 raises the back end 19 to level prior to raising the roll-in cot 10, and pressing the "−" on toggle switch 52 lowers the front end 17 to level prior to lowering the roll-in cot 10.

In one embodiment, depicted in FIG. 2, the roll-in cot 10 receives a first load signal from the front actuator sensor 62 indicative of a first force acting upon the front actuator 16 and a second load signal from the front actuator sensor 62 indicative of a second force acting upon a back actuator 18. The first load signal and second load signal may be processed by logic executed by the control box 50 to determine the response of the roll-in cot 10 to input received by the roll-in cot 10. Specifically, user input may be entered into the control box 50. The user input is received as control signal indicative of a command to change a height of the roll-in cot 10 by the control box 50. Generally, when the first load signal is indicative of tension and the second load signal is indicative of compression, the front actuator actuates the front legs 20 and the back actuator 18 remains substantially static (e.g., is not actuated). Therefore, when only the first load signal indicates a tensile state, the front legs 20 may be raised by pressing the "−" on toggle switch 52 and/or lowered by pressing the "+" on toggle switch 52. Generally, when the second load signal is indicative of tension and the first load signal is indicative of compression, the back actuator 18 actuates the back legs 40 and the front actuator 16 remains substantially static (e.g., is not actuated). Therefore, when only the second load signal indicates a tensile state, the back legs 40 may be raised by pressing the "−" on toggle switch 52 and/or lowered by pressing the "+" on toggle switch 52. In some embodiments, the actuators may actuate relatively slowly upon initial movement (i.e., slow start) to mitigate rapid jostling of the support frame 12 prior to actuating relatively quickly.

Referring collectively to FIGS. 5C-6E, independent actuation may be utilized by the embodiments described herein for loading a patient into a vehicle (note that for clarity the front actuator 16 and the back actuator 18 are not depicted in FIGS. 5C-6E). Specifically, the roll-in cot 10 can be loaded onto a loading surface 500 according the process described below. First, the roll-in cot 10 may be placed into the highest transport position (FIG. 5C) or any position where the front load wheels 70 are located at a height greater than the loading surface 500. When the roll-in cot 10 is loaded onto a loading surface 500, the roll-in cot 10 may be raised via front and back actuators 16 and 18 to ensure the front load wheels 70 are disposed over a loading surface 500.

Figure 6A:
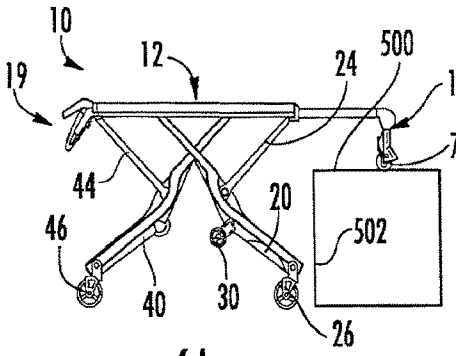
FIGS. 6A-6E is a side view depicting a loading and/or unloading sequence of a cot according to one or more embodiments shown or described herein.
Figure 6B:
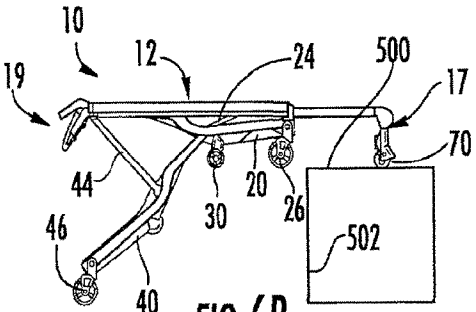

As is depicted in FIG. 6A, the front load wheels 70 are over the loading surface 500. In one embodiment, after the load wheels contact the loading surface 500 the front pair of legs 20 can be actuated with the front actuator 16 because the front end 17 is above the loading surface 500. As depicted in FIGS. 6A and 6B, the middle portion of the roll-in cot 10 is away from the loading surface 500 (i.e., a large enough portion of the roll-in cot 10 has not been loaded beyond the loading edge 502 such that most of the weight of the roll-in cot 10 can be cantilevered and supported by the wheels 70, 26, and/or 30). When the front load wheels are sufficiently loaded, the roll-in cot 10 may be held level with a reduced amount of force. Additionally, in such a position, the front actuator 16 is in tension and the back actuator 18 is in compression. Thus, for example, if the "−" on toggle switch 52 is activated, the front legs 20 are raised (FIG. 6B). In one embodiment, after the front legs 20 have been raised enough to trigger a loading state, the operation of the front actuator 16 and the back actuator 18 is dependent upon the location of the roll-in cot. In some embodiments, upon the front legs 20 raising, a visual indication is provided on the visual display component 58 of the control box 50 (FIG. 2). The visual indication may be color-coded (e.g., activated legs in green and non-activated legs in red). This front actuator 16 may automatically cease to operate when the front legs 20 have been fully retracted. Furthermore, it is noted that during the retraction of the front legs 20, the front actuator sensor 62 may detect tension, at which point, front actuator 16 may raise the front legs 20 at a higher rate, for example, fully retract within about 2 seconds.

Figure 6C:
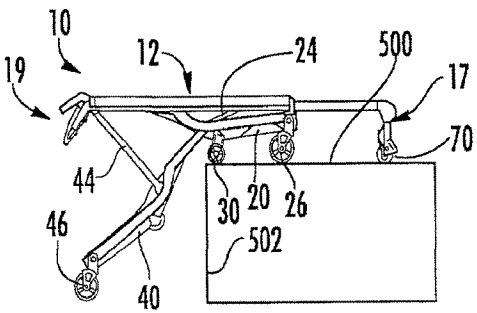

After the front legs 20 have been retracted, the roll-in cot 10 may be urged forward until the intermediate load wheels 30 have been loaded onto the loading surface 500 (FIG. 6C). As depicted in FIG. 6C, the front end 17 and the middle portion of the roll-in cot 10 are above the loading surface 500. As a result, the pair of back legs 40 can be retracted with the back actuator 18. Specifically, an ultrasonic sensor may be positioned to detect when the middle portion is above the loading surface 500. When the middle portion is above the loading surface 500 during a loading state (e.g., the front legs 20 and back legs 40 have an angle delta greater than the loading state angle), the back actuator may be actuated. In one embodiment, an indication may be provided by the control box 50 (FIG. 2) when the intermediate load wheels 30 are sufficiently beyond the loading edge 502 to allow for back leg 40 actuation (e.g., an audible beep may be provided).

It is noted that, the middle portion of the roll-in cot 10 is above the loading surface 500 when any portion of the roll-in cot 10 that may act as a fulcrum is sufficiently beyond the loading edge 502 such that the back legs 40 may be retracted a reduced amount of force is required to lift the back end 19 (e.g., less than half of the weight of the roll-in cot 10, which may be loaded, needs to be supported at the back end 19). Furthermore, it is noted that the detection of the location of the roll-in cot 10 may be accomplished by sensors located on the roll-in cot 10 and/or sensors on or adjacent to the loading surface 500. For example, an ambulance may have sensors that detect the positioning of the roll-in cot 10 with respect to the loading surface 500 and/or loading edge 502 and communications means to transmit the information to the roll-in cot 10.

Figure 6D:
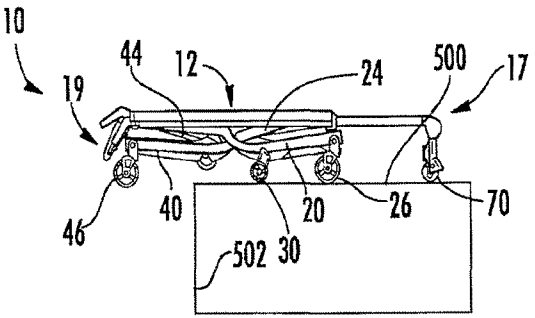

Referring to FIG. 6D, after the back legs 40 are retracted and the roll-in cot 10 may be urged forward. In one embodiment, during the back leg retraction, the back actuator sensor 64 may detect that the back legs 40 are unloaded, at which point, the back actuator 18 may raise the back legs 40 at higher speed. Upon the back legs 40 being fully retracted, the back actuator 18 may automatically cease to operate. In one embodiment, an indication may be provided by the control box 50 (FIG. 2) when the roll-in cot 10 is sufficiently beyond the loading edge 502 (e.g., fully loaded or loaded such that the back actuator is beyond the loading edge 502).

Once the cot is loaded onto the loading surface (FIG. 6E), the front and back actuators 16, 18 may be deactivated by being lockingly coupled to an ambulance. The ambulance and the roll-in cot 10 may each be fitted with components suitable for coupling, for example, male-female connectors. Additionally, the roll-in cot 10 may comprise a sensor which registers when the cot is fully disposed in the ambulance, and sends a signal which results in the locking of the actuators 16, 18. In yet another embodiment, the roll-in cot 10 may be connected to a cot fastener, which locks the actuators 16, 18, and is further coupled to the ambulance's power system, which charges the roll-in cot 10. A commercial example of such ambulance charging systems is the Integrated Charging System (ICS) produced by Ferno-Washington, Inc.

Figure 6E:
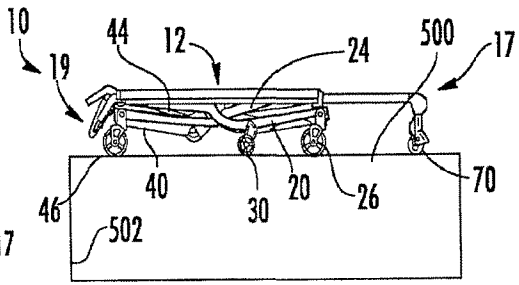
Figure 7A:
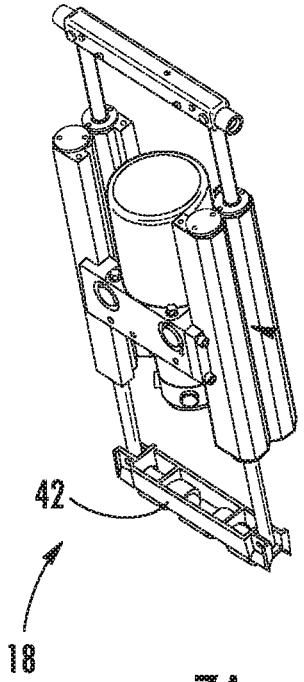
FIGS. 7A-7B are perspective views depicting an actuator according to one or more embodiments shown or described herein.
Figure 7B:
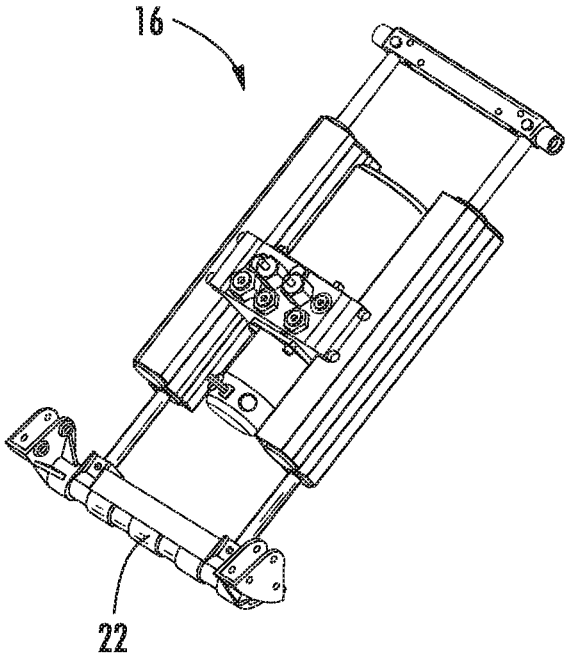

Referring collectively to FIGS. 6A-6E, independent actuation, as is described above, may be utilized by the embodiments described herein for unloading the roll-in cot 10 from a loading surface 500. Specifically, the roll-in cot 10 may be unlocked from the fastener and urged towards the loading edge 502 (FIG. 6E to FIG. 6D). As the back wheels 46 are released from the loading surface 500 (FIG. 6D), the back actuator sensor 64 detects that the back legs 40 are unloaded and allows the back legs 40 to be lowered. In some embodiments, the back legs 40 may be prevented from lowering, for example if sensors detect that the cot is not in the correct location (e.g., the back wheels 46 are above the loading surface 500 or the intermediate load wheels 30 are away from the loading edge 502). In one embodiment, an indication may be provided by the control box 50 (FIG. 2) when the back actuator 18 is activated (e.g., the intermediate load wheels 30 are near the loading edge 502 and/or the back actuator sensor 64 detects tension).

When the roll-in cot 10 is properly positioned with respect to the loading edge 502, the back legs 40 can be extended (FIG. 6C). For example, the back legs 40 may be extended by pressing the "+" on toggle switch 52. In one embodiment, upon the back legs 40 lowering, a visual indication is provided on the visual display component 58 of the control box 50 (FIG. 2). For example, a visual indication may be provided when the roll-in cot 10 is in a loading state and the back legs 40 and/or front legs 20 are actuated. Such a visual indication may signal that the roll-in cot should not be moved (e.g., pulled, pushed, or rolled) during the actuation. When the back legs 40 contact the floor (FIG. 6C), the back legs 40 become loaded and the back actuator sensor 64 deactivates the back actuator 18.

When a sensor detects that the front legs 20 are clear of the loading surface 500 (FIG. 6B), the front actuator 16 is activated. In one embodiment, when the intermediate load wheels 30 are at the loading edge 502 an indication may be provided by the control box 50 (FIG. 2). The front legs 20 are extended until the front legs 20 contact the floor (FIG. 6A). For example, the front legs 20 may be extended by pressing the "+" on toggle switch 52. In one embodiment, upon the front legs 20 lowering, a visual indication is provided on the visual display component 58 of the control box 50 (FIG. 2).

Referring back to FIG. 4, in embodiments where the hook engagement bar 80 is operable to engage with a loading surface hook 550 on a loading surface 500, the hook engagement bar 80 is disengaged prior to unloading the roll-in cot 10. For example, hook engagement bar 80 may be rotated to avoid the loading surface hook 550. Alternatively, the roll-in cot 10 may be raised from the position depicted in FIG. 4 such that the hook engagement bar 80 avoids the loading surface hook 550.

It should now be understood that the embodiments described herein may be utilized to transport patients of various sizes by coupling a support surface such as a patient support surface to the support frame. The roll-in cot includes a wheel alignment mechanism incorporated into the front legs, the wheel alignment mechanism controlling the vertical orientation of the at least one front wheel. The wheel alignment mechanism includes at least one shock absorber that absorbs an impact load applied to the at least one front wheel It is further noted that terms like "preferably," "generally," "commonly," and "typically" are not utilized herein to limit the scope of the claimed embodiments or to imply that certain features are critical, essential, or even important to the structure or function of the claimed embodiments. Rather, these terms are merely intended to highlight alternative or additional features that may or may not be utilized in a particular embodiment of the present disclosure.

For the purposes of describing and defining the present disclosure it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having provided reference to specific embodiments, it will be apparent that modifications and variations are possible without departing from the scope of the present disclosure defined in the appended claims. More specifically, although some aspects of the present disclosure are identified herein as preferred or particularly advantageous, it is contemplated that the present disclosure is not necessarily limited to these preferred aspects of any specific embodiment.

What is claimed is:

1. A roll-in cot comprising:

a support frame comprising a front end and a back end;

a front pair of legs at least one of pivotably coupled and slidingly coupled to the support frame;

a front hinge member pivotably coupled to the support frame and to one of the front pair of legs;

a front wheel linkage pivotably coupled to the front pair of legs;

a rear pair of legs at least one of pivotably coupled and slidingly coupled to the support frame;

a rear hinge member pivotably coupled to the support frame and to one of the rear pair of legs;

a rear wheel linkage pivotably coupled to the rear pair of legs; and a wheel alignment mechanism incorporated into at least one of the front or rear pairs of legs, wherein:

the front pair of legs and the rear pair of legs are pivotable relative to the support frame and independently of one another;

the front pair of legs and the front pair of hinge members pivot relative to one another in a relative angular rotation ratio;

the rear pair of legs and the rear pair of hinge members pivot relative to one another in a relative angular rotation ratio;

the wheel alignment mechanism rotates at least one of the respective wheel linkages relative to the respective pair of legs at a reduction ratio, the wheel alignment mechanism comprising:

a first hub held forming a pivot point about a location where the corresponding front or rear hinge member is coupled to the respective pair of legs through a fixed position relative to the corresponding front or rear hinge member and a rotatable position relative to the respective pair of legs;

a second hub forming a pivot point about a location where the corresponding front or rear wheel linkage is coupled to the respective pair of legs through a fixed position relative to the corresponding front or rear wheel linkage and a rotatable position relative to the respective pair of legs; and a timing mechanism rotationally coupled to and extending between the first and second hubs and rigidly coupled to at least one of the first and second hubs along at least a portion of an outer periphery of the corresponding first or second hub through at least one attachment plate such that upon raising or lowering of the respective pair of legs, the timing mechanism transmits relative rotational movement between the respective pair of legs and corresponding front or rear hinge member into a corresponding rotation of the respective wheel linkage in proportion to relative diameter differences of the first and second hubs in order to maintain a relative angular inclination of the respective wheel linkage to a ground surface.

2. The roll-in cot of claim 1, wherein one of the front pair of legs or the front pair of hinge members are slidably coupled to the support frame.

3. The roll-in cot of claim 1, wherein the timing mechanism comprises a timing chain that comprises a link coupler that joins the timing chain onto itself wherein the timing chain is continuous around its perimeter.

4. A roll-in cot comprising:

a support frame;

a plurality of legs each of which is at least one of slidably and pivotally coupled to the support frame at a leg proximal end and terminating in a wheel at a leg distal end, wherein at least one of the legs comprises:

a hinge member which extends between the support frame and an intermediate portion of the leg, the hinge member defining at both opposing ends thereof a respective pivotal coupling with the support frame and the leg;

a wheel linkage extending between the leg distal end and the wheel to define a pivotal coupling therebetween; and a wheel alignment mechanism comprising:

a first hub held forming a pivot point about a location where the hinge member is coupled to the leg through a fixed position relative to the hinge member and a rotatable position relative to the leg;

a second hub forming a pivot point about a location where the wheel linkage is coupled to the leg through a fixed position relative to the wheel linkage and a rotatable position relative to the leg; and a timing mechanism rotationally coupled to and extending between the first and second hubs and rigidly coupled to at least one of the first and second hubs along at least a portion of an outer periphery of the corresponding first or second hub through at least one attachment plate such that upon raising or lowering of the leg, the timing mechanism transmits relative rotational movement between the leg and hinge member into a corresponding rotation of the wheel linkage in proportion to relative diameter differences of the first and second hubs in order to maintain a relative angular inclination of the wheel linkage to a ground surface.

5. The roll-in cot of claim 4, further comprising a chain tensioner coupled to one of the plurality of legs, the chain tensioner contacting the timing mechanism and increasing a path length of the timing mechanism between the first hub and the second hub.

6. The roll-in cot of claim 4, wherein the timing mechanism comprises a timing chain that comprises a plurality of links coupled to one another with pins, the links being rotatable with respect to the pins, and the at least one attachment plate comprises a plurality of attachment plates coupled to the plurality of links of the timing chain.

7. The roll-in cot of claim 6, further comprising at least one idler roller coupled to one of the plurality of legs, the at least one idler roller positioned to contact the timing chain and maintain the timing chain in a first planar orientation and a second planar orientation.

8. The roll-in cot of claim 4, wherein a relative angular rotation ratio between the at least one of the legs and its respective hinge member is approximately inverse to a reduction ratio of the wheel alignment mechanism that corresponds to the relative diameter differences of the first and second hubs.

9. The roll-in cot of claim 4, wherein the timing mechanism comprises a timing belt.

10. The roll-in cot of claim 9, wherein the wheel alignment mechanism further comprises a shock absorber that selectively increases the path length of the timing belt.

11. The roll-in cot of claim 4, wherein the timing mechanism comprises a timing chain that comprises a link coupler that joins the timing chain onto itself wherein the timing chain is continuous around its perimeter.

* * * * *